US008047099B2

(12) United States Patent
St. John et al.

(10) Patent No.: US 8,047,099 B2
(45) Date of Patent: Nov. 1, 2011

(54) LARGE STRIKE FACE HAMMER

(75) Inventors: Robert A. St. John, Cheshire, CT (US); Paul Wechsler, Glastonbury, CT (US); Keith M. Lombardi, Avon, CT (US); Karl Vanderbeek, New Haven, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 217 days.

(21) Appl. No.: 12/436,035

(22) Filed: May 5, 2009

(65) Prior Publication Data

US 2010/0199809 A1 Aug. 12, 2010

Related U.S. Application Data

(60) Provisional application No. 61/151,100, filed on Feb. 9, 2009.

(51) Int. Cl.
*B25D 1/00* (2006.01)

(52) U.S. Cl. ..... 81/20

(58) Field of Classification Search ..... 81/20–26
See application file for complete search history.

(56) References Cited

U.S. PATENT DOCUMENTS

| | | | | |
|---|---|---|---|---|
| D23,169 | S | 4/1894 | Duchemin | |
| 1,727,579 | A | 9/1929 | Werra | |
| 2,603,260 | A | 7/1952 | Floren | |
| 2,623,426 | A | 12/1952 | Daniels | |
| D191,693 | S | 10/1961 | Forstrom et al. | |
| 3,130,762 | A | 4/1964 | Kerr | |
| 3,763,906 | A * | 10/1973 | Crowder | 81/24 |
| 3,821,824 | A | 7/1974 | Pilcher | 7/143 |
| 3,844,321 | A * | 10/1974 | Cook | 81/26 |
| 3,942,567 | A * | 3/1976 | Richilano | 81/26 |
| 4,240,478 | A | 12/1980 | Wilson | 81/20 |
| 4,273,172 | A * | 6/1981 | Hoosier | 81/23 |
| 4,336,832 | A * | 6/1982 | Poulos | 81/20 |
| D315,483 | S | 3/1991 | Williamson | |

(Continued)

FOREIGN PATENT DOCUMENTS

GB 859661 1/1961

OTHER PUBLICATIONS

Partial Search Report as issued for European Patent Application No. 10152893.3, dated May 31, 2010.

(Continued)

*Primary Examiner* — David B Thomas
(74) *Attorney, Agent, or Firm* — Pillsbury Winthrop Shaw Pittman LLP

(57) ABSTRACT

A hammer includes a handle and a head. The head is disposed on an upper portion of the handle. The hammer includes an overall length dimension. A ratio of the overall length dimension to the surface area of the striking surface of the head is less than 11.0. The head also includes a striking surface at one end thereof and a head weight. The head may be integrally formed with the upper portion of the handle, wherein a ratio of the head weight to the surface area of the striking surface of the head is less than 16.25. The head may alternatively be mounted on the upper portion of the handle, wherein a ratio of the head weight to the surface area of the striking surface of the head is less than 14.0. The head can have a ratio of radial measurements that is less than 1.0.

37 Claims, 30 Drawing Sheets

U.S. PATENT DOCUMENTS

| | | | | |
|---|---|---|---|---|
| 5,012,702 | A * | 5/1991 | Taylor | 81/25 |
| 5,159,858 | A | 11/1992 | Gansen | |
| 5,408,902 | A * | 4/1995 | Burnett | 81/22 |
| 6,023,997 | A * | 2/2000 | Willis et al. | 81/25 |
| D431,987 | S | 10/2000 | Staton | |
| 6,128,977 | A | 10/2000 | Gierer et al. | 81/22 |
| 6,202,511 | B1 | 3/2001 | Murray et al. | |
| 6,234,048 | B1 * | 5/2001 | Carmien | 81/22 |
| 6,332,376 | B1 * | 12/2001 | Hurley | 81/23 |
| 6,339,974 | B1 * | 1/2002 | Kotschner et al. | 81/24 |
| 6,347,562 | B1 * | 2/2002 | Gerber, Jr. | 81/25 |
| D460,337 | S | 7/2002 | Shults et al. | |
| 6,435,059 | B1 * | 8/2002 | Martinez | 81/20 |
| 6,463,832 | B1 * | 10/2002 | Cox | 81/22 |
| 6,494,119 | B1 | 12/2002 | Coonrad | 81/20 |
| 6,615,691 | B2 * | 9/2003 | Coonrad | 81/20 |
| 6,619,408 | B1 | 9/2003 | Lai | |
| D505,609 | S | 5/2005 | Hung | |
| 6,923,432 | B1 | 8/2005 | Martinez | |
| 7,096,761 | B2 * | 8/2006 | Schoor | 81/20 |
| 7,181,994 | B2 | 2/2007 | Norton | |
| 2002/0112571 | A1 * | 8/2002 | Pimentel | 81/20 |
| 2003/0029278 | A1 | 2/2003 | Macioce et al. | |
| 2003/0140734 | A1 * | 7/2003 | Tovar | 81/24 |
| 2006/0005667 | A1 | 1/2006 | Hung | |
| 2007/0163395 | A1 | 7/2007 | Wagner et al. | |
| 2008/0066582 | A1 * | 3/2008 | Chen | 81/20 |
| 2008/0072711 | A1 | 3/2008 | Toole et al. | 81/20 |
| 2009/0056504 | A1 * | 3/2009 | Atsumi et al. | 81/20 |

OTHER PUBLICATIONS

Extended Search Report as issued for European Patent Application No. 10152893.3, dated Aug. 18, 2010.

* cited by examiner

SECTION A-A

SECTION B-B

SECTION C-C

SECTION D-D

SECTION E-E

SECTION F-F

SECTION G-G

SECTION H-H

SECTION A-A

SECTION B-B

SECTION C-C

SECTION D-D

SECTION E-E

SECTION F-F

SECTION G-G

SECTION H-H

| Model # | Weight (oz.) | Description | Hammer Type | Claw style | OAL (in) | Bell diameter (in.) | Striking face diameter (in.) | Striking face area (in^2) | OAL to striking face area ratio (in/in^2) | OAL to bell diameter ratio (in/in) | Distance from striking face to handle center (in) | Face to handle distance to striking face area |
|---|---|---|---|---|---|---|---|---|---|---|---|---|
| Estwing E3-16S | 16 | 1 pc steel | nailer | rip | 13.00 | 1.16 | 1.00 | 0.79 | 16.6 | 11.21 | 2.50 | 3.18 |
| Stanley Graphite | 16 | 2 pc FG | nailer | curve | 13.00 | 1.48 | 1.27 | 1.27 | 10.3 | 8.78 | 2.65 | 1.88 |
| Stanley AVX2 | 16 | 1 pc steel | nailer | rip | 13.00 | 1.54 | 1.34 | 1.41 | 9.2 | 8.44 | 2.60 | 1.76 |
| Vaughn S2 | 18 | 3 pc | framer | rip | 18.00 | 1.42 | 1.23 | 1.19 | 15.2 | 12.68 | 2.66 | 2.24 |
| Vaughn RCF2 | 19 | 1pc steel | nailer | rip | 15.75 | 1.45 | 1.28 | 1.29 | 12.2 | 10.86 | 2.25 | 1.75 |
| Estwing E3-20 | 20 | 1pc steel | nailer | rip | 13.50 | 1.21 | 1.05 | 0.87 | 15.6 | 11.16 | 2.47 | 2.85 |
| Vaughn FS 999 | 20 | 2pc fiberglass | nailer | rip | 14.00 | 1.26 | 1.08 | 0.92 | 15.3 | 11.11 | 2.66 | 2.90 |
| Kobalt | 20 | 2 pc wood | framer | rip | 17.75 | 1.42 | 1.26 | 1.25 | 14.2 | 12.50 | 2.49 | 2.00 |
| **Stanley Graphite** | **20** | **2 pc FG** | **nailer** | **rip** | **13.00** | **1.61** | **1.37** | **1.47** | **8.8** | **8.07** | **2.74** | **1.86** |
| **Stanley AVX2** | **20** | **1 pc steel** | **nailer** | **rip** | **13.66** | **1.58** | **1.40** | **1.54** | **8.9** | **8.65** | **2.73** | **1.77** |
| **Stanley AVX2** | **20** | **1 pc steel** | **framer** | **rip** | **13.66** | **1.58** | **1.40** | **1.54** | **8.9** | **8.65** | **2.50** | **1.62** |
| Vaughn CFB21 | 21 | 2pc fiberglass | nailer | rip | 16.50 | 1.44 | 1.25 | 1.23 | 13.4 | 11.46 | 2.63 | 2.14 |
| Masterforce | 21 | 2 pc wood | framer | rip | 17.38 | 1.46 | 1.33 | 1.39 | 12.5 | 11.90 | 2.55 | 1.84 |
| Dead On (Death Stick) | 21 | 2 pc wood | framer | rip | 18.00 | 1.48 | 1.38 | 1.50 | 12.0 | 12.16 | 2.49 | 1.57 |
| Craftsman 38284 | 22 | 1pc steel | framer | rip | 16.00 | 1.30 | 1.08 | 0.92 | 17.5 | 12.31 | 2.59 | 2.83 |
| Estwing E3-22 | 22 | 1 pc steel | framer | rip | 16.00 | 1.30 | 1.09 | 0.93 | 17.1 | 12.31 | 2.59 | 2.78 |
| Vaughn R999L | 22 | 1 pc steel | nailer | rip | 16.00 | 1.32 | 1.09 | 0.93 | 17.1 | 12.12 | 2.68 | 2.87 |
| Task Force 92569 | 22 | 1pc steel | framer | rip | 16.00 | 1.31 | 1.20 | 1.13 | 14.1 | 12.21 | 2.82 | 2.49 |
| Stanley FatMax | 22 | 2 pc wood | framer | rip | 18.25 | 1.50 | 1.32 | 1.37 | 13.3 | 12.17 | 2.63 | 1.92 |
| **Stanley AVX2** | **22** | **1 pc steel** | **framer** | **rip** | **16.00** | **1.61** | **1.43** | **1.61** | **10.0** | **9.94** | **2.75** | **1.71** |
| Vaughn CF1 | 23 | 2pc wood | Cali framer | rip | 17.75 | 1.58 | 1.36 | 1.45 | 12.2 | 11.23 | 2.63 | 1.81 |
| Vaughn CF1 | 23 | 2pc wood | Cali framer | rip | 17.00 | 1.57 | 1.37 | 1.47 | 11.5 | 10.83 | 2.88 | 1.95 |
| Vaughn RCF1 "Steel Eagle" | 23 | 1pc steel | framer | rip | 17.75 | 1.57 | 1.40 | 1.54 | 11.5 | 11.31 | 3.00 | 1.95 |
| Hunter | 24 | 2 pc wood | framer | rip | 18.75 | 1.50 | 1.40 | 1.54 | 12.2 | 12.50 | 2.75 | 1.79 |
| Estwing E3-28SM | 28 | 1 pc steel | framer | rip | 16.00 | 1.42 | 1.24 | 1.21 | 13.3 | 11.27 | 2.25 | 1.86 |
| Kobalt 169549 | 28 | 1 pc steel | framer | rip | 16.00 | 1.44 | 1.29 | 1.31 | 12.2 | 11.11 | 2.25 | 1.72 |
| **Stanley AVX2** | **28** | **1 pc steel** | **framer** | **rip** | **16.00** | **1.71** | **1.51** | **1.79** | **8.9** | **9.36** | **2.63** | **1.45** |
| Vaughn 606M | 28 | 2 pc wood | framer | rip | 18.00 | 1.50 | 1.35 | 1.43 | 12.6 | 12.00 | 1.95 | 1.36 |
| Vaugh 707M | 32 | 2 pc wood | framer | rip | 18.00 | 1.55 | 1.40 | 1.54 | 11.7 | 11.61 | 1.95 | 1.27 |

TABLE 1

FIGURE 53

| Model # | Weight (oz.) | Description | Hammer Type | Claw style | OAL (in) | Bell diameter (in.) | Striking face diameter (in.) | Striking face area (in^2) | OAL to striking face area ratio (in/in^2) | OAL to bell diameter ratio (in/in) | 2pc Hammer Head weight | 2pc Head Weight to Strike Face Area Ratio | 1pc Hammer Head weight @ 3" | 1pc @ 3" Head Weight to Strike Face Area Ratio |
|---|---|---|---|---|---|---|---|---|---|---|---|---|---|---|
| Estwing E3-16S | 16 | 1 pc steel | nailer | rip | 13.00 | 1.16 | 1.00 | 0.79 | 16.6 | 11.21 | | | 16.65 | 21.20 |
| Craftsman 38125 | 16 | 2 pc Al | nailer | curve | 13.00 | 1.15 | 0.94 | 0.69 | 18.7 | 11.30 | 15.89 | 22.90 | | |
| Dead On | 16 | 2 pc wood | nailer | rip | 13.00 | 1.22 | 1.03 | 0.83 | 15.6 | 10.66 | 15.42 | 18.51 | | |
| Dead On (sample 2) | 16 | 2 pc wood | nailer | rip | 13.00 | 1.25 | 1.07 | 0.90 | 14.5 | 10.40 | 17.20 | 19.13 | | |
| Stanley Graphite | 16 | 2 pc FG | nailer | curve | 13.00 | 1.48 | 1.27 | 1.27 | 10.3 | 8.78 | 16.53 | 13.05 | | |
| Stanley AVX2 | 16 | 1 pc steel | nailer | rip | 13.00 | 1.54 | 1.34 | 1.41 | 9.2 | 8.44 | | | 18.22 | 12.92 |
| Vaughn S2 | 18 | 3 pc | framer | rip | 18.00 | 1.42 | 1.23 | 1.19 | 15.2 | 12.68 | 21.14 | 17.79 | | |
| Vaughn RCF2 | 19 | 1pc steel | nailer | rip | 15.75 | 1.45 | 1.28 | 1.29 | 12.2 | 10.86 | | | 21.07 | 16.38 |
| Estwing E3-20 | 20 | 1pc steel | nailer | rip | 13.50 | 1.21 | 1.05 | 0.87 | 15.6 | 11.16 | | | 18.77 | 21.68 |
| Vaughn FS 999 | 20 | 2pc fiberglass | nailer | rip | 14.00 | 1.26 | 1.08 | 0.92 | 15.3 | 11.11 | 18.36 | 20.05 | | |
| Kobalt | 20 | 2 pc wood | framer | rip | 17.75 | 1.42 | 1.26 | 1.25 | 14.2 | 12.50 | 20.98 | 16.83 | | |
| Stanley Graphite | 20 | 2 pc FG | nailer | rip | 13.00 | 1.61 | 1.37 | 1.47 | 8.8 | 8.07 | 20.5 | 13.91 | | |
| Stanley AVX2 | 20 | 1 pc steel | nailer | rip | 13.66 | 1.58 | 1.40 | 1.54 | 8.9 | 8.65 | | | 21.17 | 13.75 |
| Vaughn CFB21 | 21 | 2pc fiberglass | nailer | rip | 16.50 | 1.44 | 1.25 | 1.23 | 13.4 | 11.46 | 19.13 | 15.59 | | |
| Masterforce | 21 | 2 pc wood | framer | rip | 17.38 | 1.46 | 1.33 | 1.39 | 12.5 | 11.90 | 22.42 | 16.14 | | |
| Dead On | 21 | 2 pc clear wood | framer | rip | 18.00 | 1.41 | 1.41 | 1.56 | 11.5 | 12.77 | 22.21 | 14.23 | | |
| Dead On | 21 | 2 pc wood | framer | rip | 18.00 | 1.40 | 1.25 | 1.23 | 14.7 | 12.86 | 21.80 | 17.77 | | |
| Dead On (Death Stick) | 21 | 2 pc wood | framer | rip | 18.00 | 1.48 | 1.38 | 1.50 | 12.0 | 12.16 | 21.80 | 14.58 | | |
| Craftsman 38284 | 22 | 1pc steel | framer | rip | 16.00 | 1.30 | 1.08 | 0.92 | 17.5 | 12.31 | | | 24.24 | 26.47 |
| Estwing E3-22 | 22 | 1 pc steel | framer | rip | 16.00 | 1.30 | 1.09 | 0.93 | 17.1 | 12.31 | | | 19.75 | 21.17 |
| Vaughn R999L | 22 | 1 pc steel | nailer | rip | 16.00 | 1.32 | 1.09 | 0.93 | 17.1 | 12.12 | | | 22.44 | 24.05 |
| Task Force 92569 | 22 | 1pc steel | framer | rip | 16.00 | 1.31 | 1.20 | 1.13 | 14.1 | 12.21 | | | 21.52 | 19.03 |
| Stanley FatMax | 22 | 2 pc wood | framer | rip | 18.25 | 1.50 | 1.32 | 1.37 | 13.3 | 12.17 | 26.82 | 19.60 | | |
| Dead On (Square face) | 22 | 1pc steel | framer | rip | 18.00 | | | 1.29 | 14.0 | | | | 23.37 | 18.12 |
| Stanley AVX2 | 22 | 1 pc steel | framer | rip | 16.00 | 1.61 | 1.43 | 1.61 | 10.0 | 9.94 | | | 24.16 | 15.05 |
| Vaughn CF1 | 23 | 2pc wood | Cali framer | rip | 17.75 | 1.58 | 1.36 | 1.45 | 12.2 | 11.23 | 23.29 | 16.04 | | |
| Vaughn CF1 | 23 | 2pc wood | Cali framer | rip | 17.00 | 1.57 | 1.37 | 1.47 | 11.5 | 10.83 | 22.62 | 16.51 | | |
| Vaughn RCF1 "Steel Eagle" | 23 | 1pc steel | framer | rip | 17.75 | 1.57 | 1.40 | 1.54 | 11.5 | 11.31 | | | 27.63 | 17.95 |
| Hunter | 24 | 2 pc wood | framer | rip | 18.75 | 1.50 | 1.40 | 1.54 | 12.2 | 12.50 | 22.96 | 16.40 | | |
| Dead On | 24 | 2 pc wood | framer | rip | 18.00 | 1.40 | 1.25 | 1.23 | 14.7 | 12.86 | 21.80 | 17.44 | | |
| Estwing E3-28SM | 28 | 1 pc steel | framer | rip | 16.00 | 1.42 | 1.24 | 1.21 | 13.3 | 11.27 | | | 23.33 | 19.32 |
| Kobalt 169549 | 28 | 1 pc steel | framer | rip | 16.00 | 1.44 | 1.29 | 1.31 | 12.2 | 11.11 | | | 26.66 | 20.40 |
| Stanley AVX2 | 28 | 1 pc steel | framer | rip | 16.00 | 1.71 | 1.51 | 1.79 | 8.9 | 9.36 | | | 28.90 | 16.14 |
| Vaughn 606M | 28 | 2 pc wood | framer | rip | 18.00 | 1.50 | 1.35 | 1.43 | 12.6 | 12.00 | 26.10 | 19.33 | | |
| Vaugh 707M | 32 | 2 pc wood | framer | rip | 18.00 | 1.55 | 1.40 | 1.54 | 11.7 | 11.61 | 30.20 | 21.57 | | |

Legend: not applicable

TABLE 2

FIGURE 54

| Hammer Radius 1 vs. Radius 2 comparison | | | | | |
|---|---|---|---|---|---|
| **Manufacturer** | **Model** | **Size (oz)** | **R1** | **R2** | **R2/R1 Ratio** |
| Stanley | AVX2 | 16 | 0.67 | 0.46 | **0.69** |
| Estwing | | 16 | 0.49 | 0.57 | 1.17 |
| Stanley | FM Graphite | 16 | 0.64 | 0.45 | **0.70** |
| Stanley | AVX2 | 20 | 0.70 | 0.49 | **0.70** |
| Estwing | | 20 | 0.52 | 0.61 | 1.16 |
| Vaughan | FS 999 | 20 | 0.53 | 0.63 | 1.18 |
| Kobalt | 145193 | 20 | 0.63 | 0.71 | 1.14 |
| Stanley | FM Graphite | 20 | 0.69 | 0.46 | **0.67** |
| Dead On | 2pc | 21 | 0.64 | 0.71 | 1.11 |
| Stanley | AVX2 | 22 | 0.72 | 0.59 | **0.82** |
| Craftsman | 38284 | 22 | 0.54 | 0.65 | 1.20 |
| Estwing | | 22 | 0.55 | 0.65 | 1.18 |
| Vaughan | R999L | 22 | 0.54 | 0.66 | 1.24 |
| Vaughan | CFI | 23 | 0.68 | 0.79 | 1.16 |
| Dead On | 2pc | 24 | 0.62 | 0.70 | 1.13 |
| Hunter | 2pc | 24 | 0.70 | 0.75 | 1.06 |
| Stanley | AVX2 | 28 | 0.75 | 0.66 | **0.87** |
| Kobalt | 169549 | 28 | 0.65 | 0.73 | 1.12 |

TABLE 3

FIGURE 55

LARGE STRIKE FACE HAMMER

CROSS REFERENCE TO RELATED APPLICATIONS

The present application claims priority to U.S. Provisional Application Ser. No. 61/151,100, filed on Feb. 9, 2009, the entirety of which is hereby incorporated into the present application by reference.

BACKGROUND OF THE INVENTION

Field of the Invention

The present invention relates to hammers and more particularly to a hammer having a large strike surface.

Conventional hammers typically include a head (e.g., made of steel, or titanium) fixedly secured to or integrally formed with a rigid handle. During use, a striking surface disposed on the head of the hammer is configured to strike against an object, such as a nail or chisel.

SUMMARY OF THE INVENTION

One aspect of the present invention provides a hammer that includes a handle and a head. The handle includes a bottom end and an upper portion. The head is disposed on the upper portion of the handle. The head includes a striking surface at one end thereof. The hammer includes an overall length dimension. A ratio of the overall length dimension of the hammer measured in inches to the surface area of the striking surface of the head measured in square inches is less than 11.0.

Another aspect of the present invention provides a hammer that includes a handle and a head. The handle includes a bottom end and an upper portion. The head is disposed on the upper portion of the handle. The head includes a striking surface at one end thereof. The head includes a plurality of circumferentially spaced recesses located adjacent to but spaced from the striking surface of the head.

Another aspect of the present invention provides a hammer that includes a handle and a head. The handle includes a bottom end and an upper portion. The head is disposed on the upper portion of the handle. The head includes a striking surface at one end thereof and a head weight. The head of the hammer is integrally formed with the upper portion of the handle. A ratio of the head weight of the hammer, measured in ounces at 3.0 inches from the top of the head, to the surface area of the striking surface of the head measured in square inches, is less than 16.25.

Another aspect of the present invention provides a hammer that includes a handle and a head. The handle includes a bottom end and an upper portion. The head is disposed on the upper portion of the handle. The head includes a striking surface at one end thereof and a head weight. The head is mounted on the upper portion of the handle by inserting the upper portion of the handle into a portion of the head of the hammer. A ratio of the head weight of the hammer measured in ounces to the surface area of the striking surface of the head measured in square inches is less than 14.0.

Yet another aspect of the present invention provides a hammer that includes a handle and a head. The handle has a bottom end and an upper portion. The head is disposed on the upper portion of the handle. The head includes a striking surface at one end thereof. The striking surface of the head has a first radius measurement. The head of the hammer has a second radius measurement. The second radius measurement is measured at a section of the head that is positioned a distance from the striking surface of the head. The distance for taking the section is substantially equal to the first radius measurement. A ratio of the first radius measurement to the second radius measurement is of the head is less than 1.0.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

BRIEF DESCRIPTION OF THE DRAWINGS

FIG. 53 shows a Table 1 providing a comparison and overview of embodiments of the integral hammer and of the two-piece hammer in accordance with the present invention in comparison with various hammers across a sampling of multiple brands and/or models;

FIG. 54 shows a Table 2 providing a comparison and overview of embodiments of the integral hammer and of the two-piece hammer in accordance with the present invention in comparison with various hammers across a sampling of multiple brands and/or models, and FIG. 55 shows a Table 3 providing a comparison and overview of embodiments of the integral hammer and of the two-piece hammer in accordance with the present invention in comparison with various hammers across a sampling of multiple brands and/or models.

DETAILED DESCRIPTION OF THE INVENTION

Figure 1:
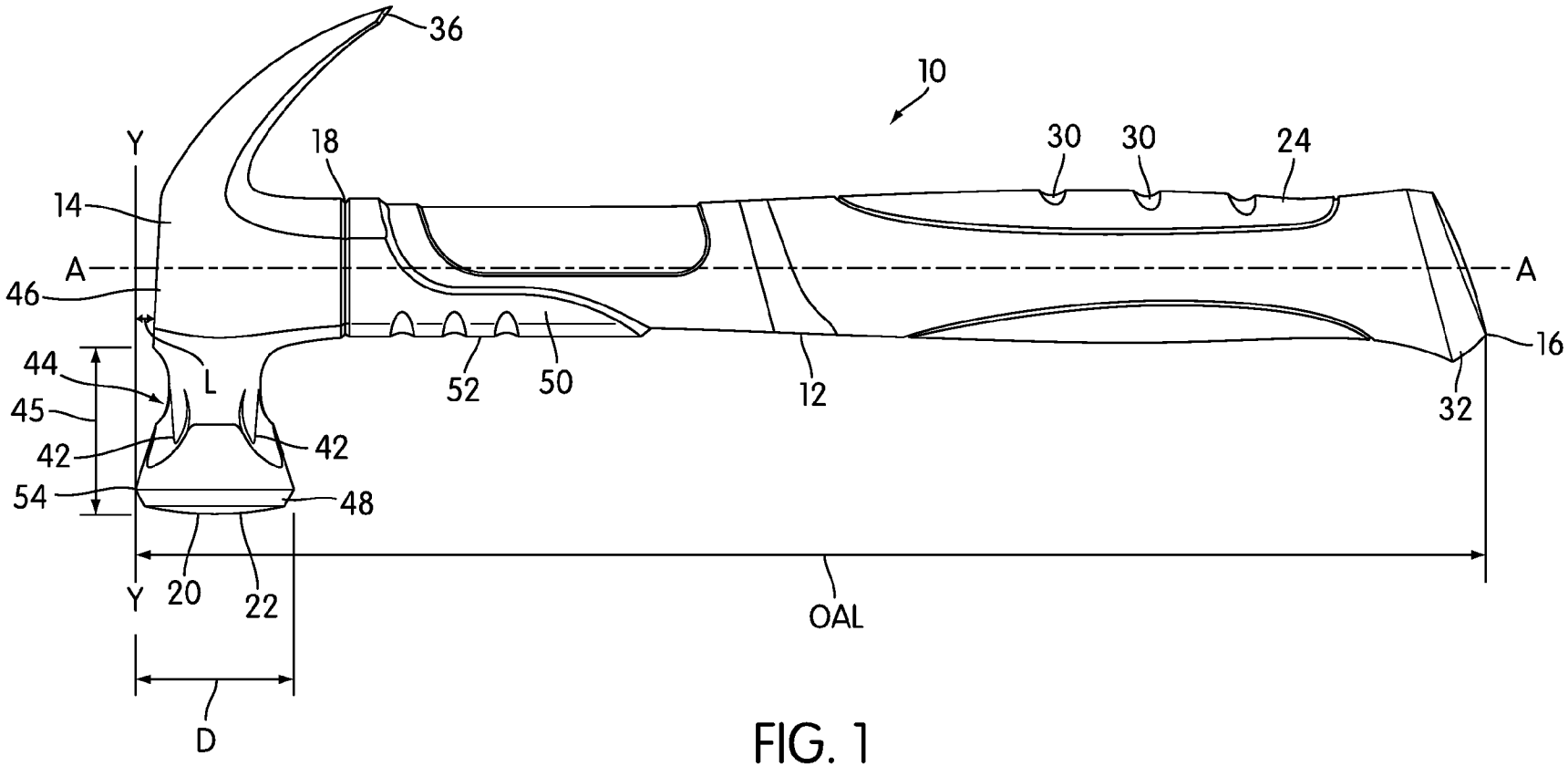
FIG. 1 is a left hand side elevational view of a hammer in accordance with an embodiment of the present invention.
Figure 2:
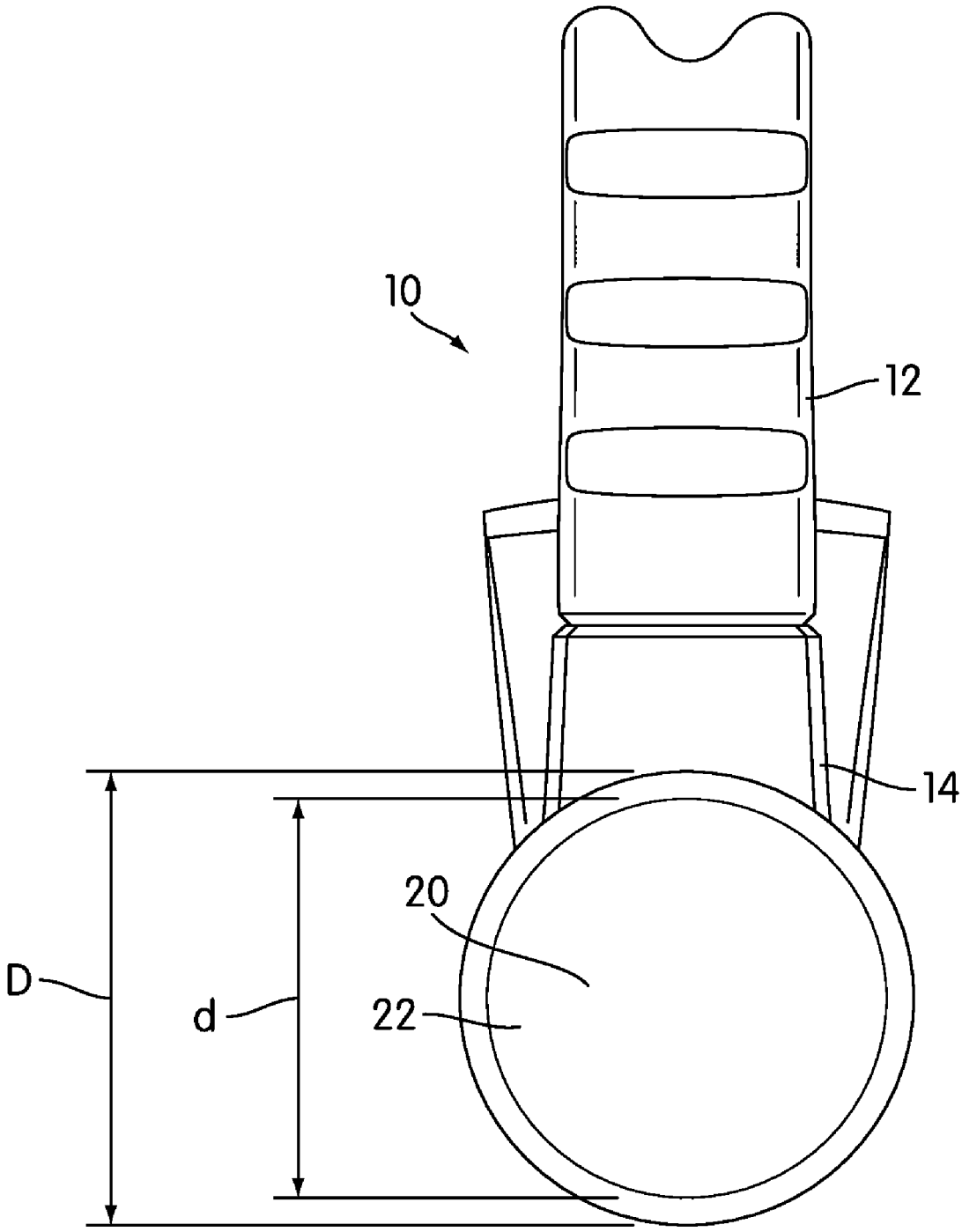
FIG. 2 is a partial front view of the hammer in accordance with an embodiment of the present invention.

FIGS. 1 and 2 show a hammer 10 in accordance with an embodiment of the present invention. The hammer 10 includes a handle 12 and a head 14. The handle 12 includes a bottom end 16 and an upper portion 18. The head 14 is disposed on the upper portion 18 of the handle 12. The head 14 includes a striking surface 20 at one end 22 thereof. The hammer 10 includes an overall length dimension OAL. In one embodiment, a ratio of the overall length dimension OAL of the hammer to the surface area of the striking surface 20 of the head 14 is less than 11.0.

In one embodiment, the handle 12 is made of metal, a composite material, or a synthetic material. In another embodiment, the handle 12 of the hammer 10 is made of a lighter material, such as wood, aluminum, a plastic material, a fiberglass material, or other suitable material. As shown in FIG. 1, the hammer 10 includes a manually engageable gripping portion 24. In one embodiment, the gripping portion 24 is simply the outer surface of the handle material (e.g., wood or metal). In another embodiment, the manually engageable gripping portion 24 of the hammer 10 is molded onto an inner or core portion of the handle 12. In one embodiment, the gripping portion 24 of the handle 12 is made of an elastomeric material, a rubber based material, a plastic based material or other suitable material. Optionally, the gripping portion 24 can be ergonomically shaped. For example, a plurality of arcuate indentations 30 spaced longitudinally along the surface 28. As shown in FIG. 1, the gripping portion 24 includes a butt-end portion 32.

As shown in FIG. 1, in one embodiment, the hammer 10 may optionally include an over-strike protecting structure 50 constructed and arranged to surround a portion 52 of the handle 12 adjacent to (beneath) the upper portion 18 of the handle 12. The over-strike protecting structure 50 may be adjacent to the head 14. In one embodiment, the over-strike structure 50 is on a leading edge of the handle 12 directly underneath the head 14. The over-strike protecting structure 50 is constructed and arranged to protect the handle 12 and/or reduce vibration imparted to the user's hand during an over-strike (i.e., when the striking surface 20 of the hammer 10 misses or fails to strike an intended object, such as nail or a chisel, and the handle 12 strikes the wood or other surface). In one embodiment, the over-strike protecting structure 50 includes an additional or extra layer or mass of resilient material (such as an elastomer or rubber based material) molded on the portion 52 of the handle 12 to dissipate impact energy and stress due to an overstrike. In one embodiment, the over-strike protecting structure 50 is constructed and arranged to provide a high degree of cushioning to protect the user's hand from the kinetic energy transferred thereto during impact of the striking surface against the object, such as a nail or a chisel.

Figure 3:
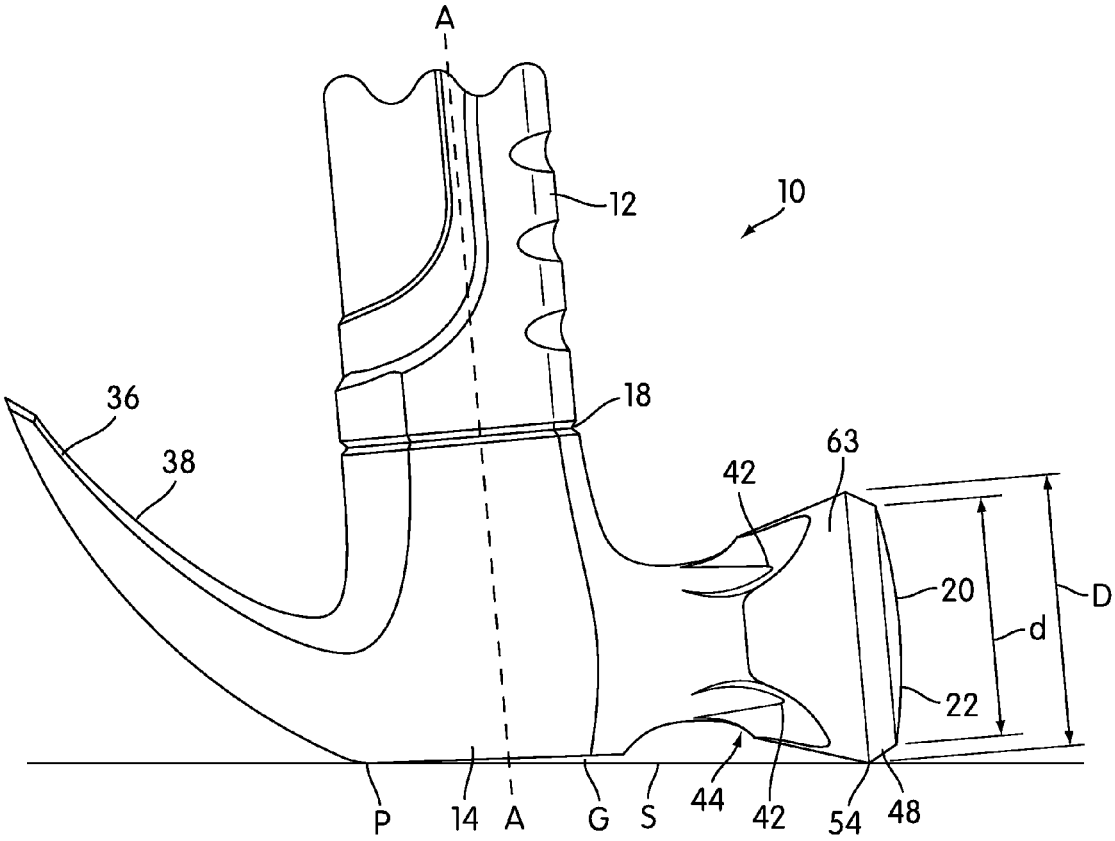
FIG. 3 is a partial left hand side elevational view of the hammer in accordance with an embodiment of the present invention, showing the hammer in an upside down orientation with the head resting on a surface.
Figure 19:
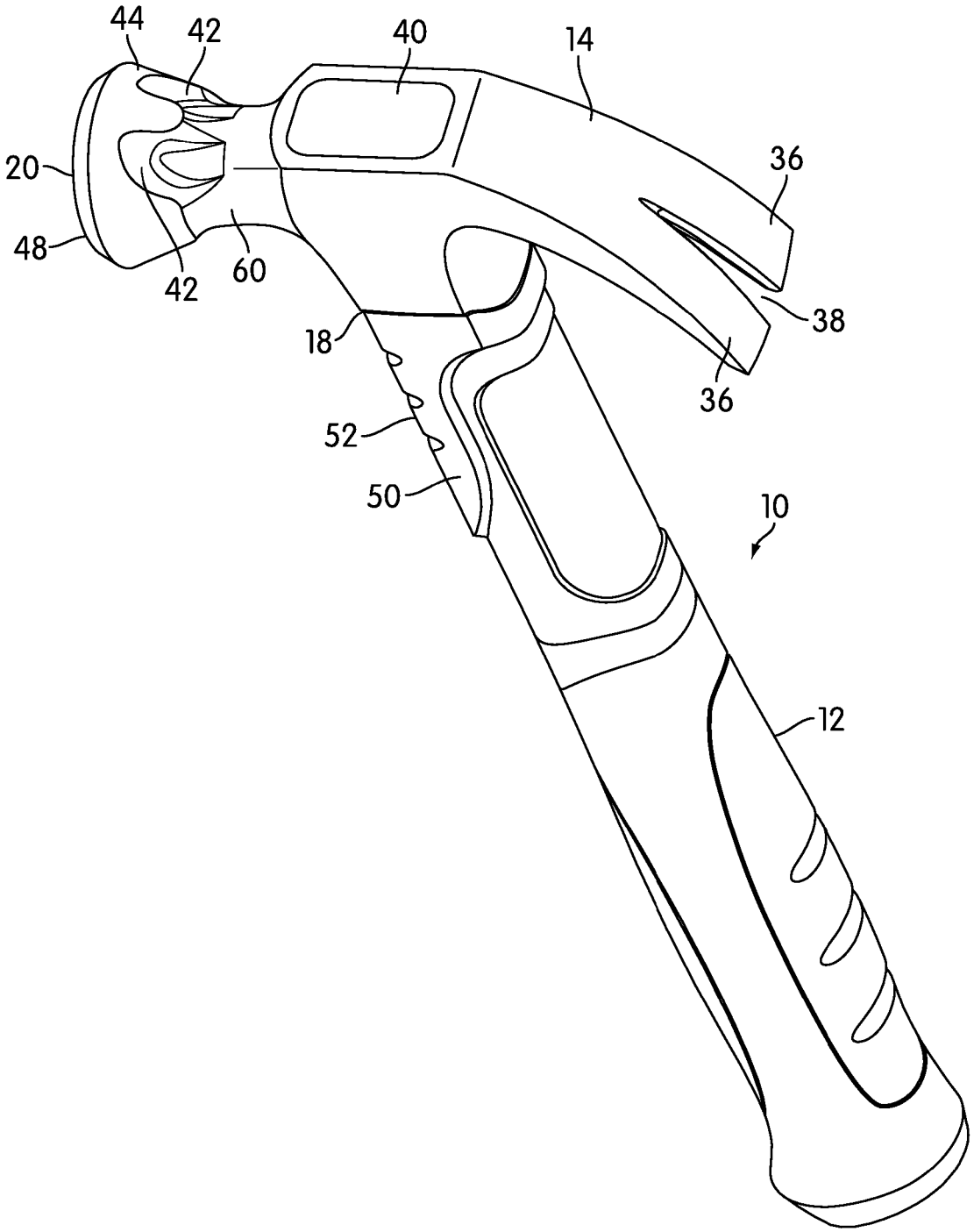
FIG. 19 is a perspective view of a two-piece hammer in accordance with an embodiment of the present invention.
Figure 20:
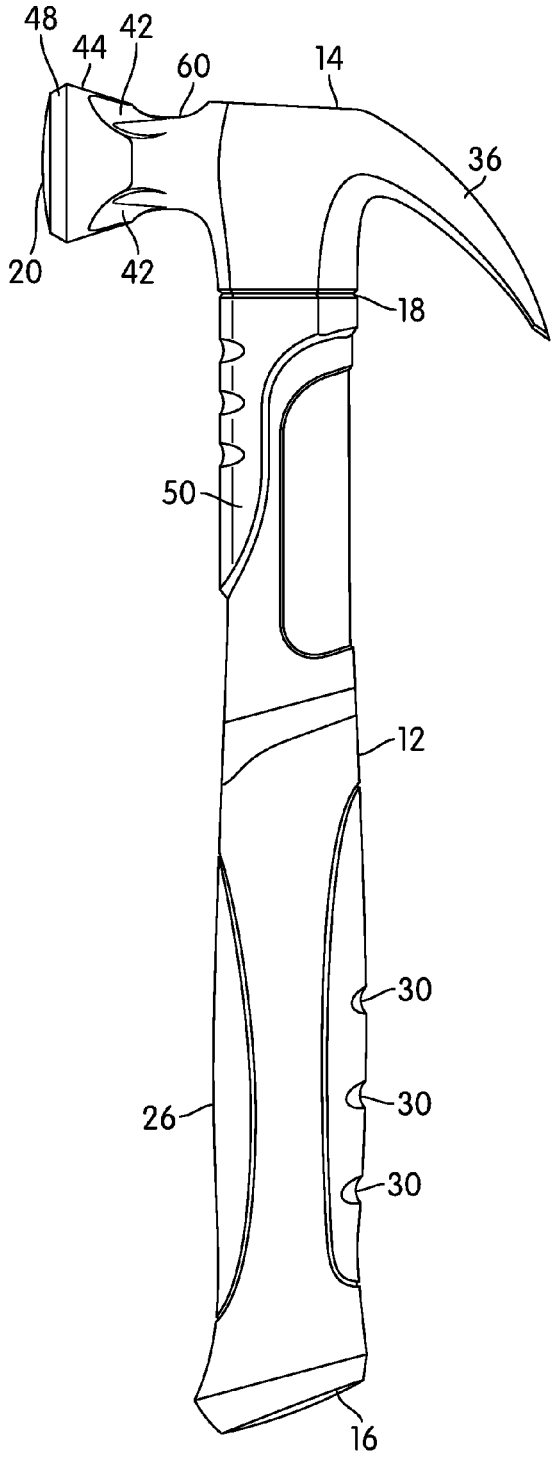
FIG. 20 is a is a left hand side elevational view of the two-piece hammer in accordance with an embodiment of the present invention.
Figure 21:
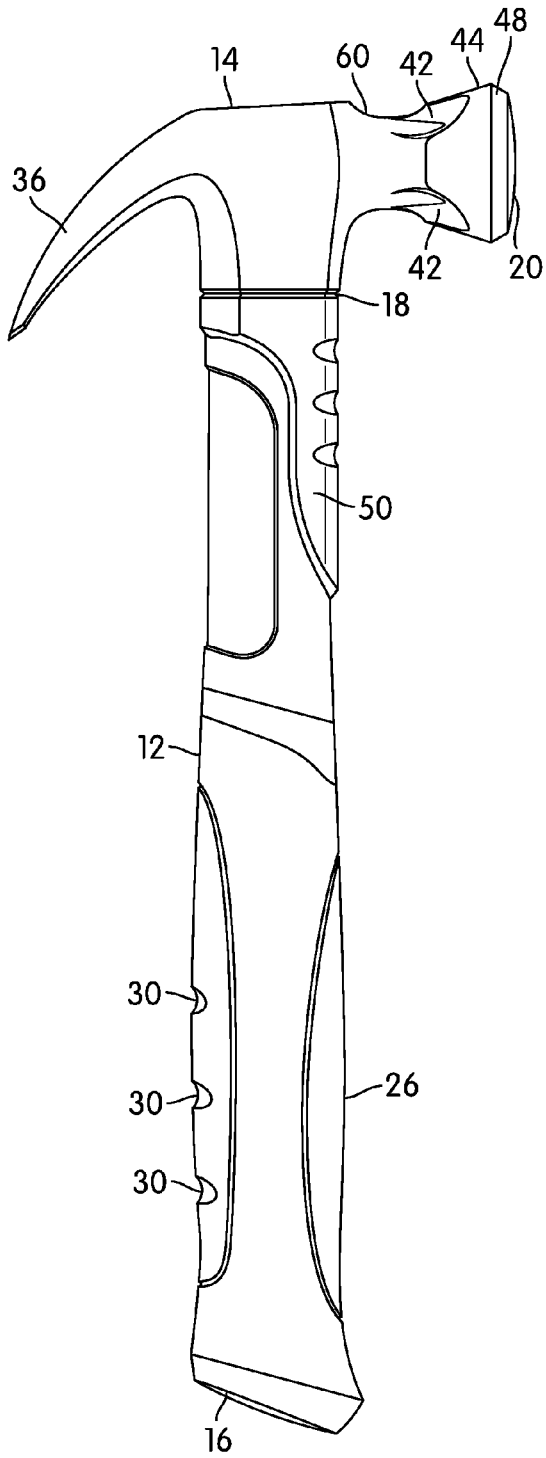
FIG. 21 is a right hand side elevational view of the two-piece hammer in accordance with an embodiment of the present invention.
Figure 22:
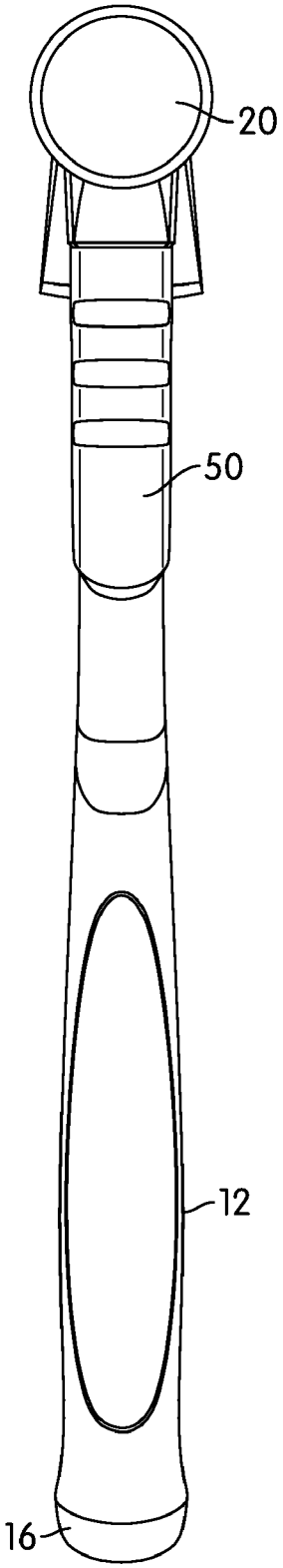
FIG. 22 is a front elevational view of the two-piece hammer in accordance with an embodiment of the present invention.
Figure 23:
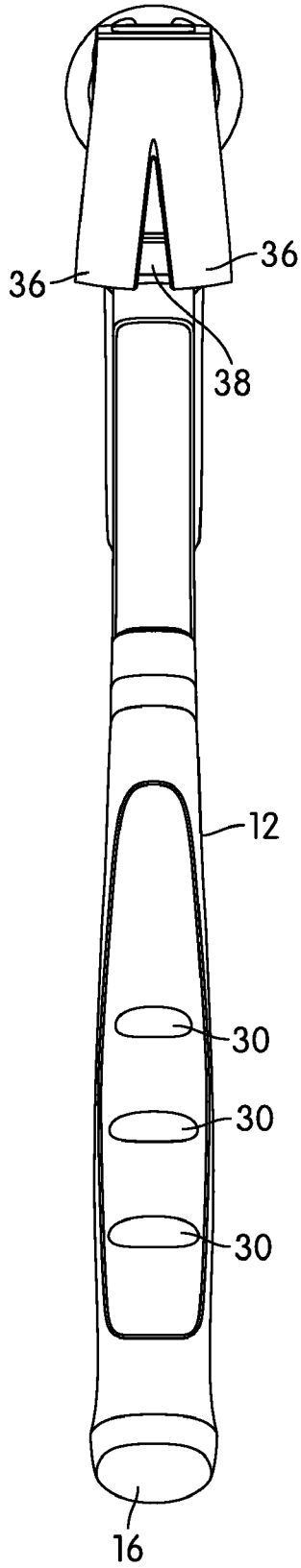
FIG. 23 is a rear elevational view of the two-piece hammer in accordance with an embodiment of the present invention.

As shown in FIGS. 1 and 3, the head 14 of the hammer 10 includes the striking surface 20, and a pair of tapered, spaced-apart nail removing claws 36, (e.g., see FIG. 19). In one embodiment, the nail removing claws 36 of the head 14 of the hammer 10 are spaced apart so as to provide a V-shaped space 38 therebetween. The shank of a nail can be received in the V-shaped space 38 with the top of the hammer 10 facing the work piece and the nail is removed by engaging the spaced apart claws 36 with the head of the nail and withdrawing the nail from a work piece. In some embodiments, no claw is provided (e.g., a ball peen hammer). In one embodiment, the head 14 of the hammer 10 is made of steel, iron, titanium, or other suitable metal material. In one embodiment, a bell 44 located at the forward portion of the head 14 of the hammer 10 includes the striking surface 20. A chamfer or bevel 48 is located circumferentially along the edges of the striking surface 20 of the hammer 10. The total diameter of the bell is indicated by "D" and includes the dimensions of the chamfer 48. The diameter of the strike face 20 is indicated at "d" and excludes chamfer 48. When the hammer is swung in a swing plane of the hammer 10 (i.e., a plane, which, as viewed in FIG. 2, is perpendicular to the page and extends longitudinally through the center of the hammer), the striking surface 20 strikes an object, such as a nail or a chisel.

In one embodiment, the striking surface 20 of the hammer 10 is slightly convex in order to facilitate square contact during driving of nails.

Figure 24:
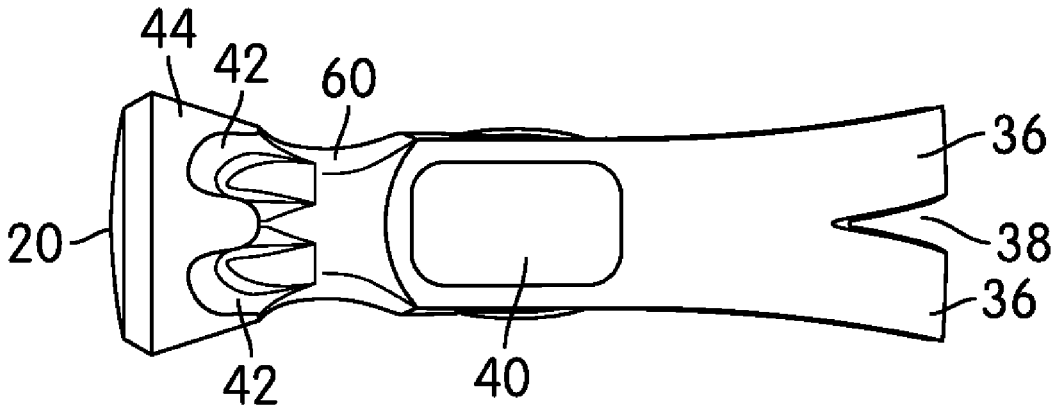
FIG. 24 is a top plan view of the two-piece hammer in accordance with an embodiment of the present invention.
Figure 25:
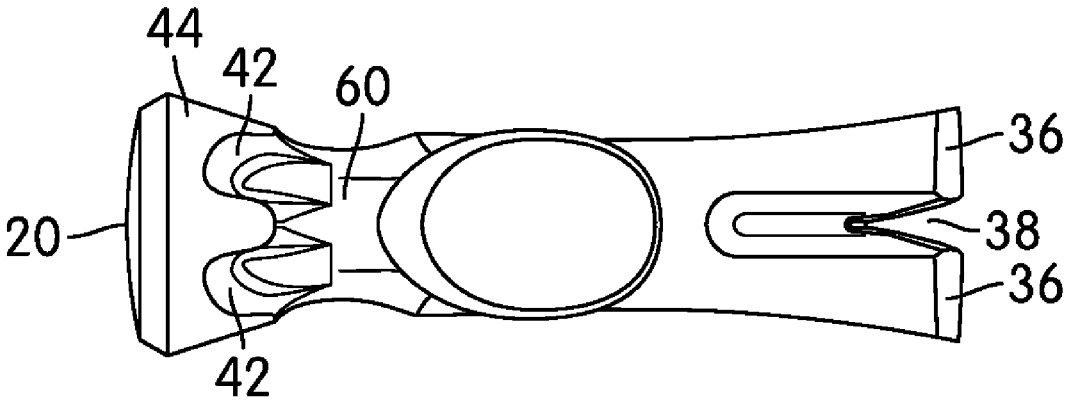
FIG. 25 is a bottom plan view of the two-piece hammer in accordance with an embodiment of the present invention.

As noted above, the head 14 of the hammer 10 is disposed at the upper portion 18 of the handle 12. In one embodiment, the head 14 of the hammer 10 is integrally formed with the upper portion 18 of the handle 12, as shown in FIGS. 4-9. In this embodiment, the handle has a metal (e.g., steel or titanium) shaft integrally formed with the head of the same material. In one embodiment, a covering of different material (e.g., an elastomer material) may be provided on top of the metal shaft. In another embodiment, the head and the handle are formed separately and then connected to one another. As shown in FIGS. 19-25, the head 14 of the hammer 10 may be mounted on the upper portion 18 of the handle 12 by securing the upper portion 18 of the handle 12 into a portion (e.g., an eye portion 40 as shown in FIGS. 19 and 24) of the head 14 of the hammer 10. Any suitable manner of connecting the head 14 and handle 12 may be employed. In this embodiment, the handle shaft can be made from a different material than the head.

As noted above, the hammer 10 includes the overall length dimension OAL. In one embodiment, as shown in FIG. 1, the overall length dimension OAL of the hammer 10 is measured along (or relative to) a central longitudinal axis A-A of the hammer 10. The overall length dimension OAL is measured from the bottom-most end surface 16 of the handle 12 to a top most end 54 of the head 14, taken along axis A-A as shown. In the illustrated embodiment, the top-most axial point of the head 14 is disposed at a top surface of the bell 44.

In one embodiment, as shown in FIGS. 1 and 3, a plurality of circumferentially spaced recesses 42 are located adjacent to but spaced from the striking surface 20 of the head 14. A relatively large strike surface 20 is provided without substantially increasing the overall weight of the overall hammer 10 or of the head 14 by providing the recesses 42. The material in these plurality of circumferentially spaced recesses 42 is removed in comparison with prior art configurations; the term "removed" as used herein does not require that the material first be provided in such regions and then taken away. Rather the recesses can be formed during the initial molding, forging, or casting, or can be formed after the molding, forging, or casting to provide a large striking surface 20 and maintain the overall weight of the hammer 10.

Similarly, in the case of integrally formed (one-piece) hammers (as shown in FIGS. 4-18), the hammer head can be provided with the plurality of circumferentially spaced recesses 42 during the normal stroke of the molding, casting, or forging press, or can be formed after the same.

In one embodiment, as shown in FIG. 1, the major diameter D of the poll 45 is higher than a top central surface 46 of the hammer head 14. FIG. 1 shows a line Y-Y that is perpendicular to the central axis A-A of the hammer 10, and passes through a top end 54 of the bell 44. The top central surface 46 of the hammer head 14 is located at a distance L lower than the line Y-Y (i.e., that terminates at the upper surface of the bell 44).

During a nail pulling operation, this configuration of the hammer i.e., the major diameter D (largest diameter) of the poll 45 extending higher than the top central surface 46 (or any other surface) of the hammer head 14, causes the nail to be pulled out of the work piece in a generally straight line direction. Even though the major diameter D of the poll 45 extends higher than the top central surface 46 of the hammer head 14, the hammer 10 is nevertheless constructed and arranged to be able to stand or rest on the head 14 in an upside down configuration on a horizontal rest surface, thus, allowing the user to store the hammer 10 with handle 12 pointing in a generally upward direction (as shown in FIG. 3). As shown in FIG. 3, when the hammer head 14 rests on a planar, horizontal surface, the points of contact with surface S are formed (1) at the major diameter D (or upper most surface 54) of the poll 45, (2) at point (P) on the head 14, which is disposed on a side of the central axis A that is opposite from the poll 45. In addition, as shown, a gap G is formed between the two points of contact. It can also be seen that on the poll 45 side of the central axis A, the only portion of the head 14 that contacts the horizontal planar surface S is formed at the top surface 54 of the poll 45 (outermost diameter D of the poll).

FIGS. 4-9 show an integrally formed hammer 10 in accordance with an embodiment of the present invention. In non-limiting examples, the weight of the integrally formed hammer 10 is nominally between 16 and 28 ounces; and the overall length dimension of the integrally formed hammer is between 13 and 16 inches. In another embodiment, the nominal weight of the integrally formed hammer 10 may be 7 ounces, 13 ounces, or 32 ounces. In one embodiment, the handle 12 and the head 14 of the hammer 10 are made from steel material. In one embodiment, the integrally formed hammer 10 may be a framer-type hammer or a nailer-type hammer and may include a rip-type claw style. Note that the weight of the hammer nominally listed on the hammer itself is a measure of the weight of the head and is not the weight of the entire hammer. The overall weight of the hammer is higher than the weight listed. For example, a hammer marked 16 ounces may weigh approximately 24 ounces.

Figure 4:
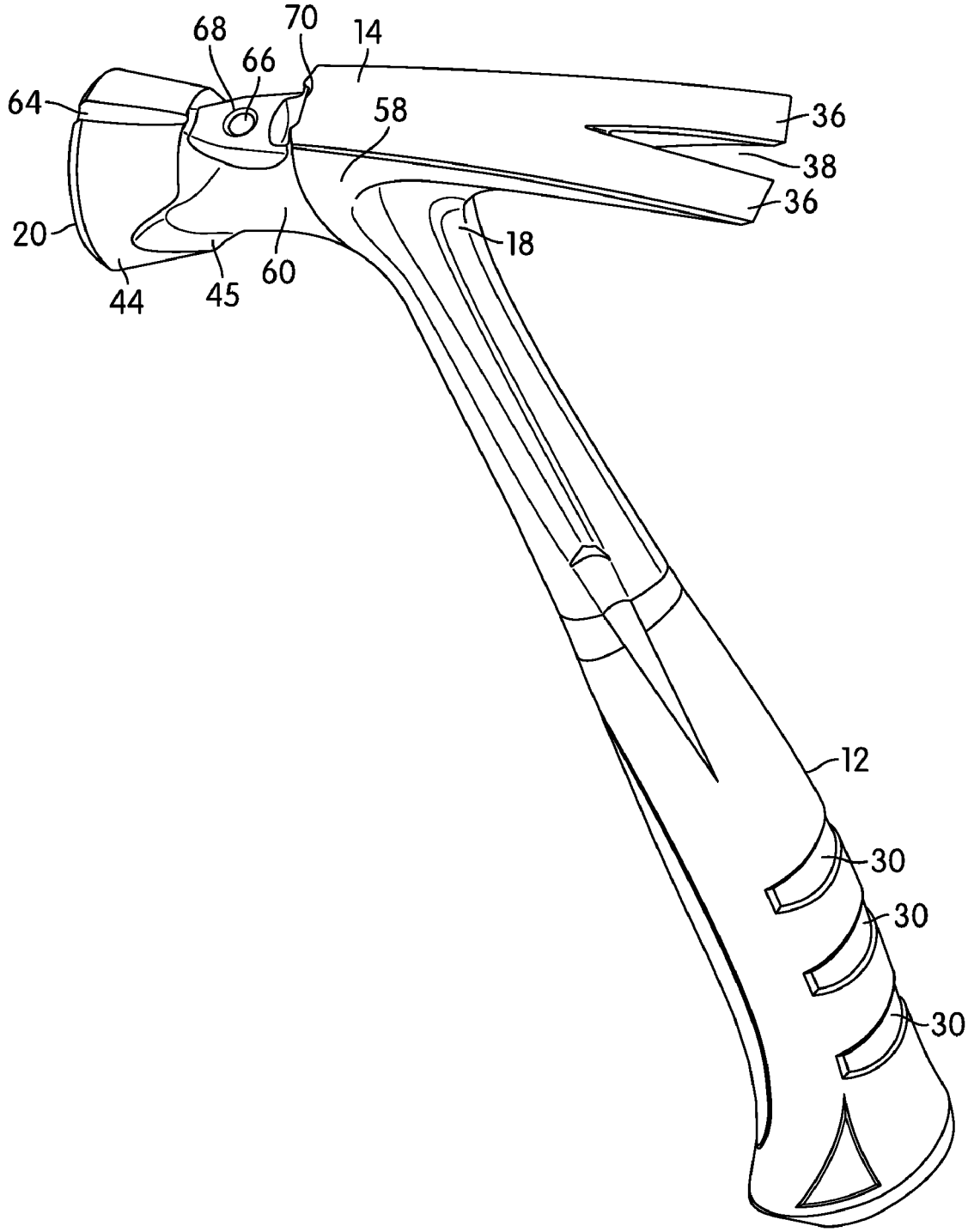
FIG. 4 is a perspective view of an integrally formed hammer in accordance with an embodiment of the present invention.
Figure 5:
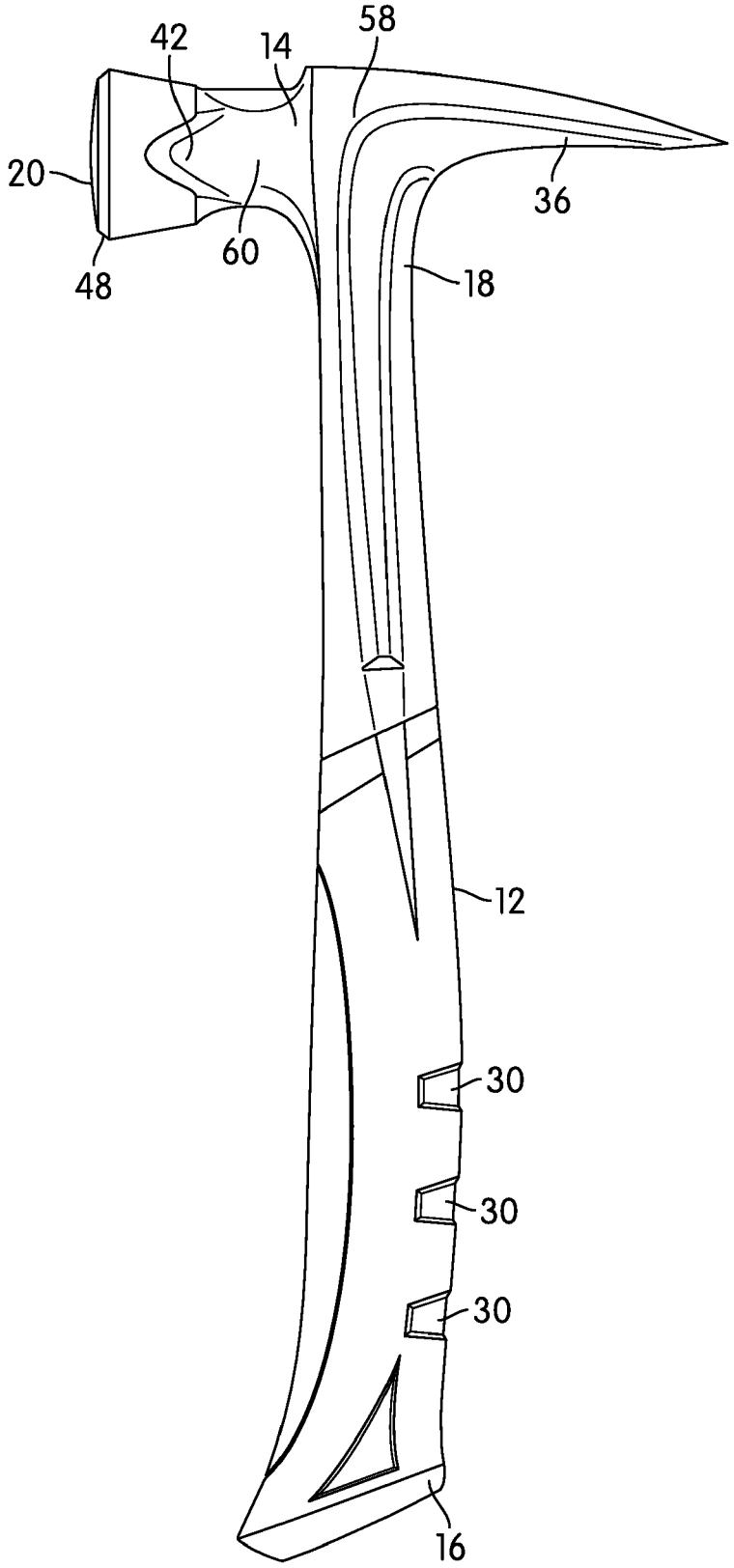
FIG. 5 is a left hand side elevational view of the integrally formed hammer in accordance with an embodiment of the present invention.
Figure 6:
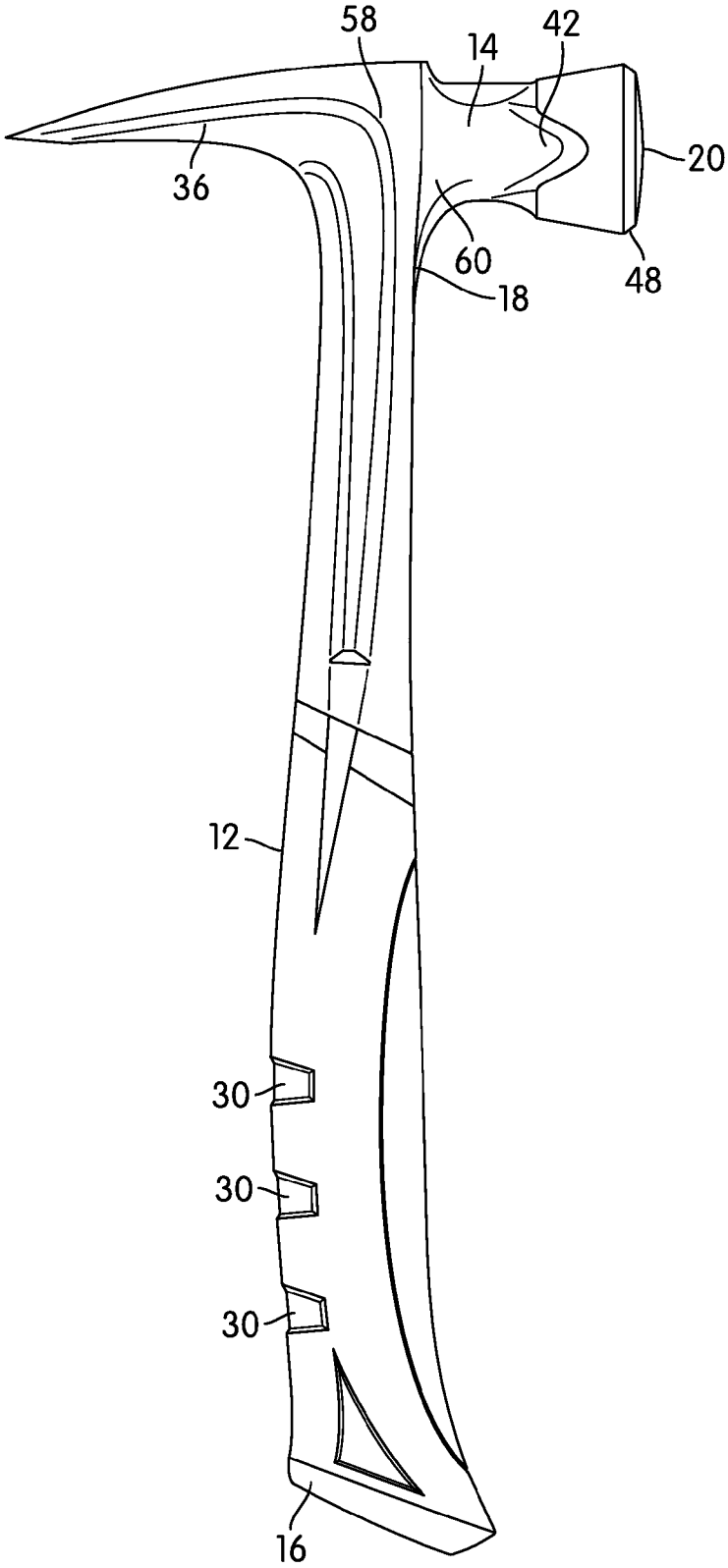
FIG. 6 is a right hand side elevational view of the integrally formed hammer in accordance with an embodiment of the present invention.
Figure 7:
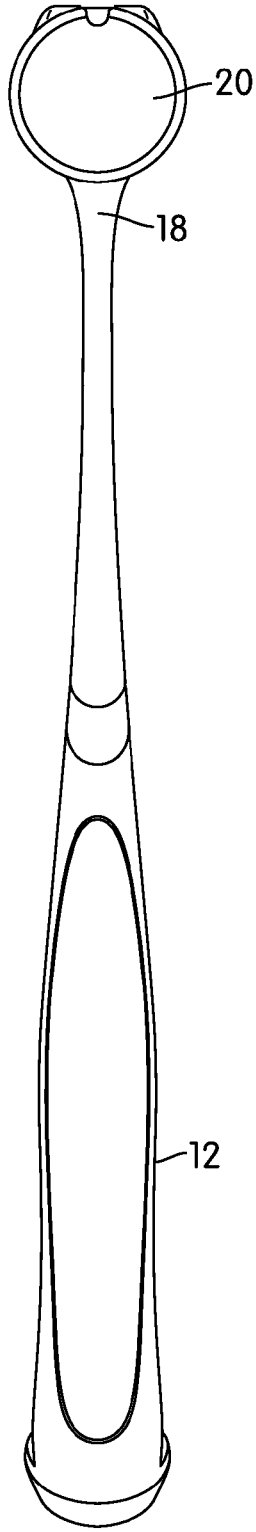
FIG. 7 is a front elevational view of the integrally formed hammer in accordance with an embodiment of the present invention.
Figure 8:
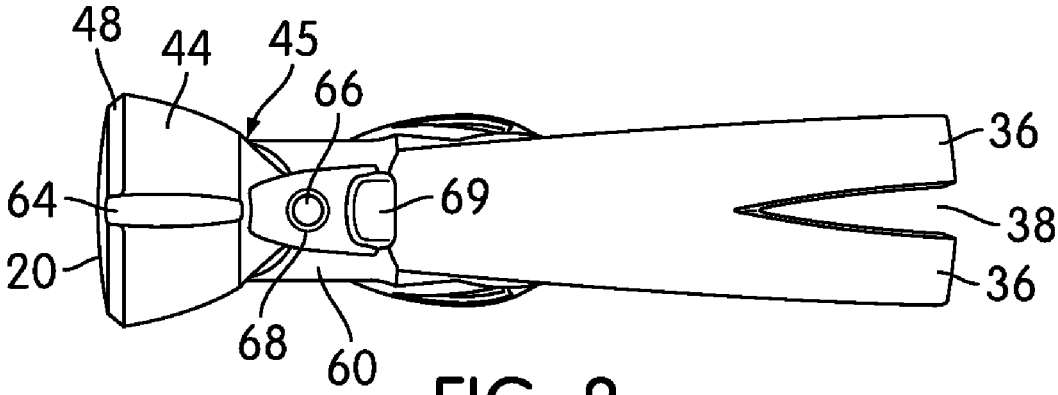
FIG. 8 is a top plan view of the integrally formed hammer in accordance with an embodiment of the present invention.
Figure 9:
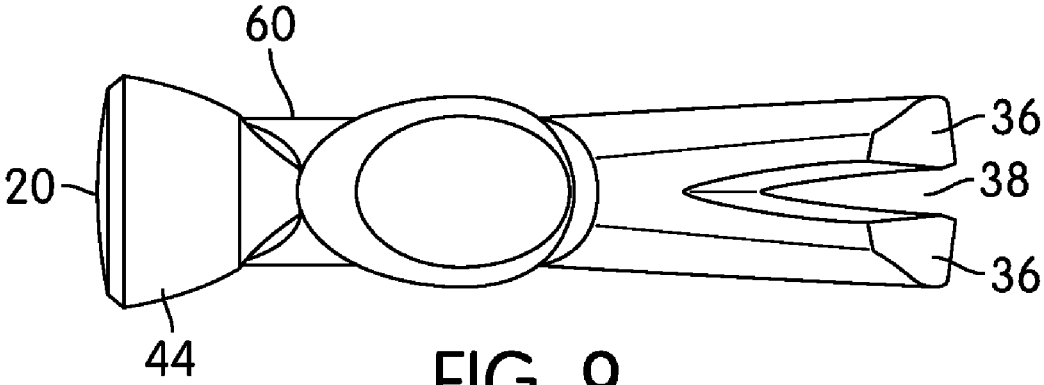
FIG. 9 is a bottom plan view of the integrally formed hammer in accordance with an embodiment of the present invention.
Figure 10:
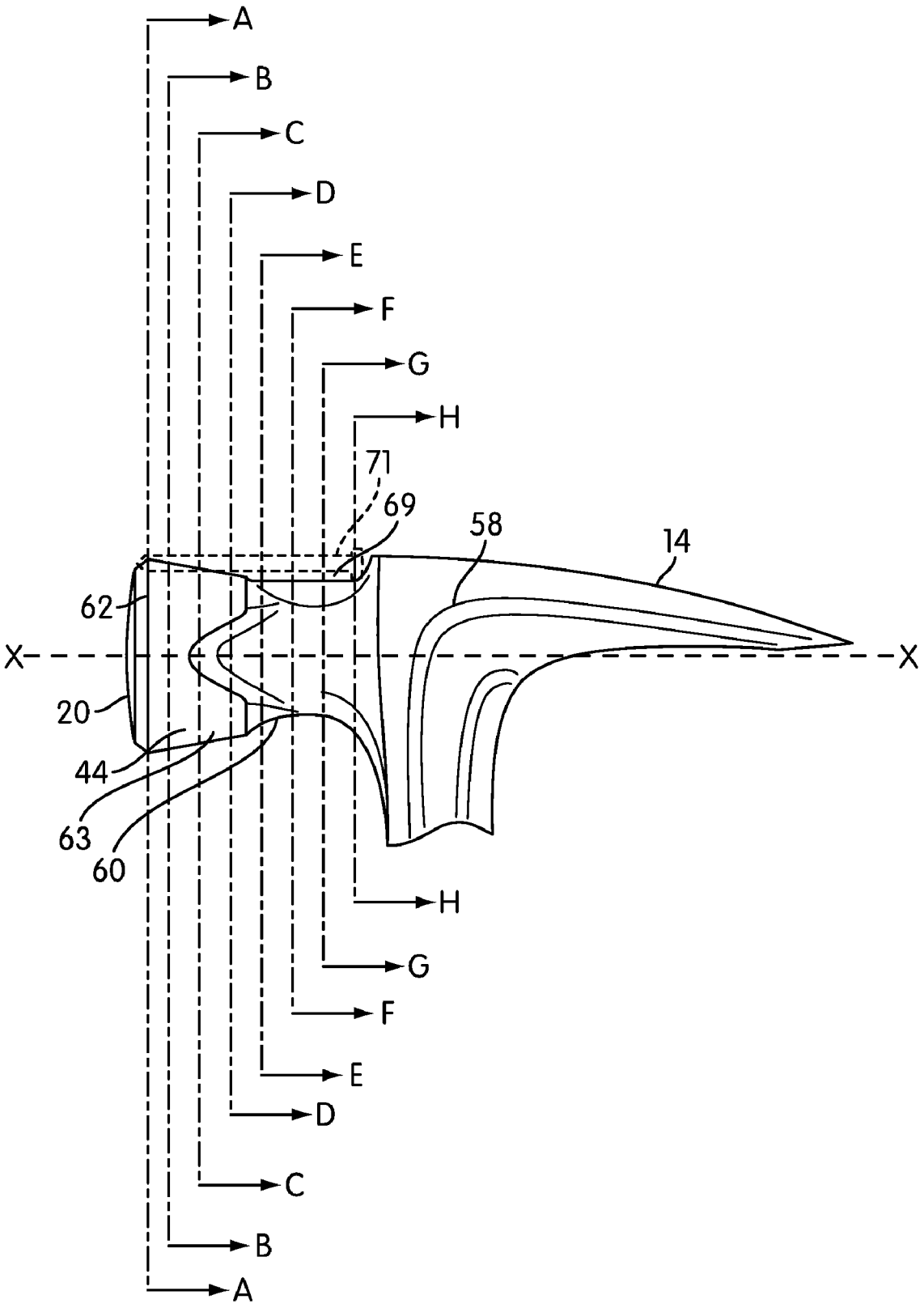
FIG. 10 is a partial left hand side elevational view of the integrally formed hammer illustrating different cross-sections therethrough in accordance with an embodiment of the present invention.
Figure 16:
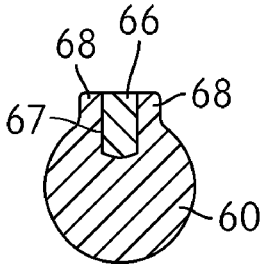
FIG. 16 is a sectional view thereof along the line F-F of FIG. 10 in accordance with an embodiment of the present invention.
Figure 18:
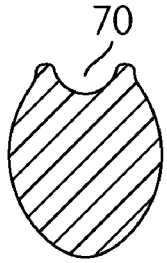
FIG. 18 is a sectional view thereof along the line H-H of FIG. 10 in accordance with an embodiment of the present invention.

As shown in FIGS. 4 and 8, a groove 64 is located along a top surface of the bell 44. The groove 64 is constructed and arranged to receive and retain a nail 71 therein (see FIG. 10), when the nail 71 is placed in an initial nail driving position to facilitate the start of a nail driving operation. An opening 66 is located on a top surface of the poll 45 (i.e., on neck portion 60 that connects the bell 44 with the body portion 58 of the head 14) as shown in FIGS. 4 and 8. In one embodiment, the opening or groove 66 may be disposed on a ribbed portion 68 formed on the neck portion 60. As shown in FIG. 16, a magnet 67 is located in the opening or groove 66. The magnet 67 is constructed and arranged to help retain the nail 71 in the initial nail driving position in the groove 64 to facilitate the start of the nail driving operation. As shown in FIGS. 4 and 18, a notch 70 is disposed on the top surface of a portion that connects the neck portion 60 and the body portion 58. As shown in FIG. 10, a surface 69 of the hammer 10 is constructed and arranged to support a head of the nail 71 (shown in dashed lines). Thus, the groove 64, the magnet 67, and the surface 69 act together to position and to initially drive the nail 71 in a first blow into a work piece. The nail starter arrangement that includes the groove 64, magnet 67, and the surface 69 are optional.

FIG. 10 shows a partial left hand side elevational view of the integrally formed hammer 10 illustrating different cross-sections being therethrough in accordance with an embodiment of the present invention. FIGS. 11-18 show the progressive cross-sectional views of the head 14 of the integrally formed hammer 10 taken along various sections (i.e., at lines A-A through H-H of FIG. 10) moving from the striking surface 20 of the head 14 to the body portion 58 (as shown in FIG. 10) of the head 14. The section lines are taken generally parallel to a central axis A of the hammer 10, and generally perpendicular to a central axis X through the poll 45.

Figure 11:
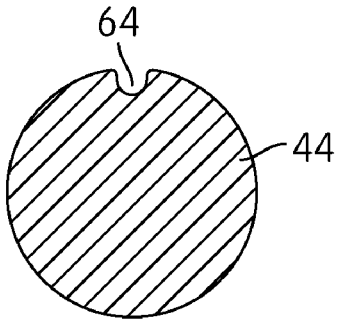
FIG. 11 is a sectional view thereof along the line A-A of FIG. 10 in accordance with an embodiment of the present invention.
Figure 12:
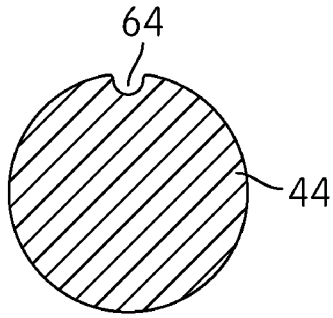
FIG. 12 is a sectional view thereof along the line B-B of FIG. 10 in accordance with an embodiment of the present invention.

FIGS. 11 and 12 show a generally circular shape of the head 14 of the integrally formed hammer 10, except for notch 64, when the cross-sections are taken along lines A-A and B-B respectively. In one embodiment, the section A-A may be at or near the striking surface 20, while the section B-B is slightly spaced from the striking surface 20.

Figure 13:
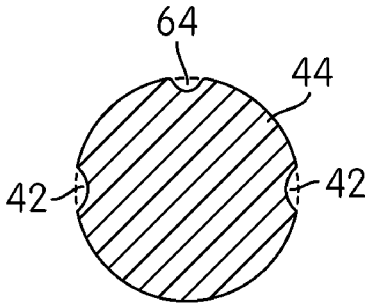
FIG. 13 is a sectional view thereof along the line C-C of FIG. 10 in accordance with an embodiment of the present invention.
Figure 14:
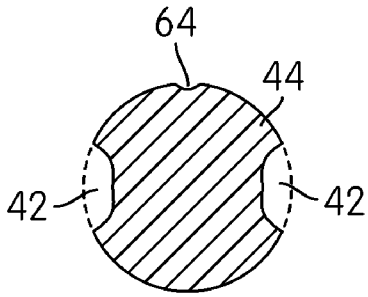
FIG. 14 is a sectional view thereof along the line D-D of FIG. 10 in accordance with an embodiment of the present invention.

FIGS. 13 and 14 show cross-sectional views of the head 14 of the integrally formed hammer 10 taken along the lines C-C and D-D respectively. In one embodiment, the lines C-C and D-D pass through the plurality of circumferentially spaced recesses 42 that are located adjacent to but spaced from the striking surface 20 of the head 14 of the integrally formed hammer 10. As shown in FIGS. 13 and 14, the plurality of recesses 42 (i.e., two shown in the illustrated embodiment) are spaced circumferentially around the bell 44 of the head 14. The upper groove 64 (as shown in FIGS. 4 and 8) of the hammer 10 is shown in the cross-sectional views in FIGS. 11-14

Figure 15:
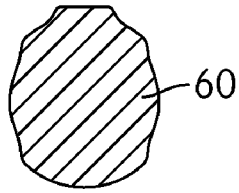
FIG. 15 is a sectional view thereof along the line E-E of FIG. 10 in accordance with an embodiment of the present invention.
Figure 17:
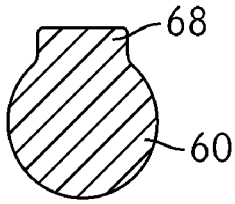
FIG. 17 is a sectional view thereof along the line G-G of FIG. 10 in accordance with an embodiment of the present invention.

FIGS. 15-17 show cross-sectional views of the head 14 of the integrally formed hammer 10, when the cross-sections are taken along lines E-E, F-F, and G-G respectively. The opening 66 (as shown in FIGS. 4 and 8) for receiving the magnet 67 is shown in the cross-sectional view in FIG. 16. The ribbed portion 68 (as shown in FIGS. 4 and 8) of the integrally formed hammer 10 within which the opening or groove 66 is disposed is shown in the cross-sectional view in FIGS. 16 and 17.

FIG. 18 shows a cross-sectional view of the head 14 of the integrally formed hammer 10 taken along the line H-H. In one embodiment, the line H-H passes through a portion of the head 14 of the integrally formed hammer 10 that connects the neck portion 60 and the body portion 58. The notch 70 disposed on a top surface of the portion that connects the neck portion 60 and the body portion 58 is shown in the cross-sectional view shown in FIG. 18.

The cross-sectional views shown in FIGS. 11-16 show a gradual taper in the diameter of the head 14 (i.e., along the bell 44 and the neck portion 60) of the integrally formed hammer 10. In another embodiment, instead of a gradual taper in the diameter of the head 14, the diameter of the head 14 may include parabolic-shaped configuration, convex-shaped configuration or any other suitable shaped configuration. The diameter of the head 14 of the integrally formed hammer 10 decreases gradually from an end 62 (as shown in FIG. 10) of the bell 44 to a central portion 63 of the neck portion 60. The cross-sectional views shown in FIGS. 17 and 18 show a gradual taper in the diameter of the head 14 (i.e., along the neck portion 60 and the portion connecting the neck portion 60 and the body portion 58) of the integrally formed hammer 10. The diameter of the head 14 of the integrally formed hammer 10 increases gradually from the central portion of the neck portion 60 to the portion connecting the neck portion 60 and the body portion 58.

FIGS. 19-25 show different views of a two-piece hammer in accordance with an embodiment of the present invention, which is similar to the embodiment of FIGS. 1-3. In non-limiting examples, the weight of the two-piece hammer 10 may be between 16 and 20 ounces; and the overall length dimension of the two-piece hammer may be between 12 and 15 inches (e.g., about 13 inches). The head 14 of the two-piece hammer 10 is mounted on the upper portion 18 of the handle 12 by inserting the upper portion 18 of the handle 12 into a portion (i.e., an eye portion 40 as shown in FIGS. 19 and 24) of the head 14 of the hammer 10. In one embodiment, the core or shaft of the handle 12 of the hammer 10 may be made from fiberglass material. Other materials, such as wood, steel, or titanium may also be used for the core or shaft. In one embodiment, the two-piece hammer 10 may be a nailer-type hammer and may include a rip or curve style claw. In general, the hammers made with claws include two different configurations, the curve claw configuration and the rip claw configuration. In the curve claw configuration, the head of the hammer may generally weigh 20 ounces or less. Also, in the curve claw configuration, the hammers may generally have shorter handles. The hammers with the curve claw configuration are generally used by carpenters during removal of a lot of small nails. The hammers having the rip claw configuration include a straighter configuration, and are available in all head weights and head lengths.

Figure 26:
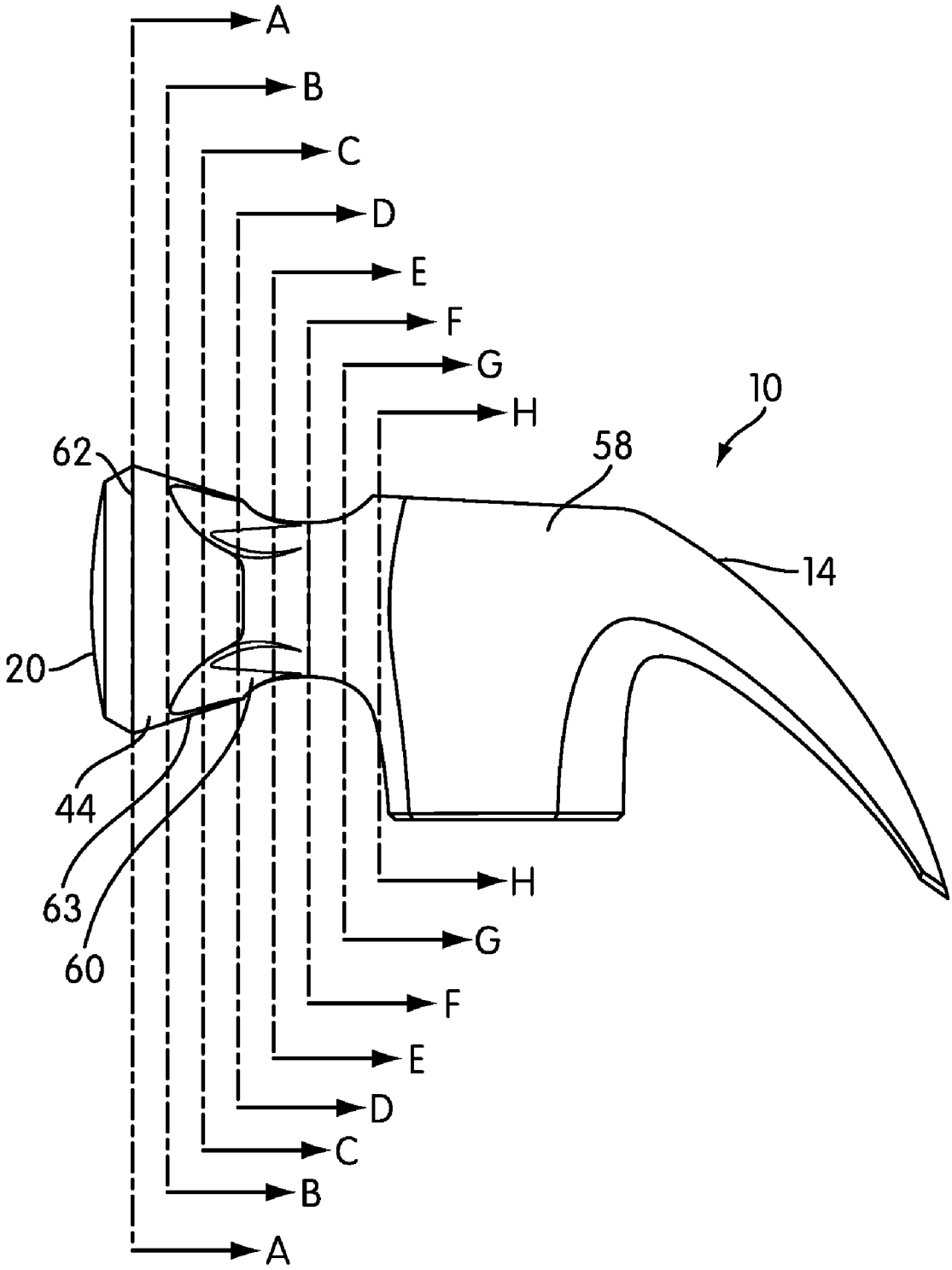
FIG. 26 is a partial left hand side elevational view of the two-piece hammer illustrating different cross-sections therethrough in accordance with an embodiment of the present invention.

FIG. 26 shows a partial left hand side elevational view of the two-piece hammer 10 illustrating different cross-sections being taken therethrough in accordance with an embodiment of the present invention. FIGS. 27-34 show progressive cross-sectional views of the head 14 of the two-piece hammer 10 taken along various sections of FIG. 26 (i.e., at lines A-A through H-H) moving from the striking surface 20 of the head 14 to the body portion 58 (as shown in FIG. 26) of the head 14 of the two-piece hammer 10.

Figure 27:
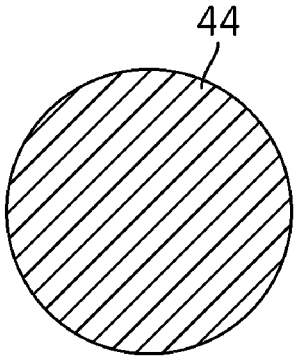
FIG. 27 is a sectional view thereof along the line A-A of FIG. 26 in accordance with an embodiment of the present invention.
Figure 28:
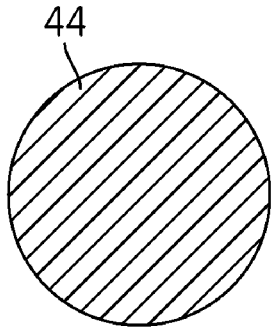
FIG. 28 is a sectional view thereof along the line B-B of FIG. 26 in accordance with an embodiment of the present invention.

FIGS. 27 and 28 show a generally circular shape of the head 14 of the two-piece hammer 10, when the cross-sections are taken along lines A-A and B-B respectively. In one embodiment, the section A-A may be at or near the striking surface 20, while section B-B is slightly spaced from the striking surface 20.

Figure 29:
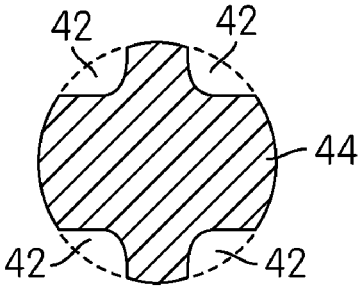
FIG. 29 is a sectional view thereof along the line C-C of FIG. 26 in accordance with an embodiment of the present invention.
Figure 30:
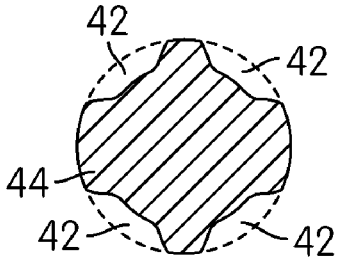
FIG. 30 is a sectional view thereof along the line D-D of FIG. 26 in accordance with an embodiment of the present invention.

FIGS. 29 and 30 show cross-sectional views of the head 14 of the two-piece hammer 10 taken along the lines C-C and D-D respectively. In one embodiment, the lines C-C and D-D pass through the plurality of circumferentially spaced recesses 42 that are located adjacent to but commence at positions spaced from the striking surface 20 of the head 14 of the two-piece hammer 10. As shown in FIGS. 29 and 30, the plurality of recesses 42 (e.g., four shown in the illustrated embodiment) are spaced circumferentially around the bell 44 of the head 14.

Figure 31:
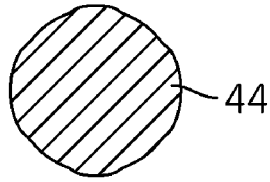
FIG. 31 is a sectional view thereof along the line E-E of FIG. 26 in accordance with an embodiment of the present invention.
Figure 32:
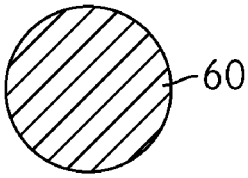
FIG. 32 is a sectional view thereof along the line F-F of FIG. 26 in accordance with an embodiment of the present invention.
Figure 33:
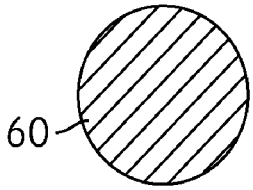
FIG. 33 is a sectional view thereof along the line G-G of FIG. 26 in accordance with an embodiment of the present invention.
Figure 34:
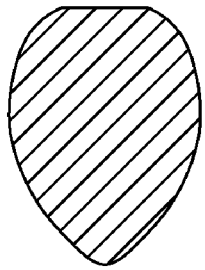
FIG. 34 is a sectional view thereof along the line H-H of FIG. 26 in accordance with an embodiment of the present invention.

FIGS. 31-33 show a generally circular shape of the head 14 of the two-piece hammer 10, when the cross-sections are taken along lines E-E, F-F, and G-G respectively. FIG. 34 shows a cross-sectional view of the head 14 of the two-piece hammer 10 taken along the line H-H. In one embodiment, the line H-H passes through a portion of the head 14 of the two-piece hammer 10 that is connecting the neck portion 60 and the body portion 58.

The cross-sectional views shown in FIGS. 27-32 show a gradual taper in the diameter of the head 14 (i.e., along the bell 44 and the neck portion 60) of the two-piece hammer 10. The diameter of the head 14 of the two-piece hammer 10 decreases gradually from the end 62 (as shown in FIG. 26) of the bell 44 to a central portion 63 of the neck portion 60. The cross-sectional views shown in FIGS. 33 and 34 show a gradual taper in the diameter of the head 14 (i.e., along the neck portion 60 and the portion connecting the neck portion 60 and the body portion 58) of the two-piece hammer 10. The diameter of the head 14 of the two-piece hammer 10 increases gradually from the central portion of the neck portion 60 to the portion connecting the neck portion 60 and the body portion 58.

FIG. 53 shows a TABLE 1 which provides a comparison and overview of particular embodiments of the integral hammer and of the two-piece hammer in accordance with the invention disclosed herein in comparison with various hammers across a sampling multiple brands and/or models. Among other things, this table provides a comparative or a relative measurement of the ratio of the overall length dimension OAL of the hammer to the surface area of the striking surface of the head of the hammer for the various hammers.

The first column in TABLE 1 provides a model number of the hammer under consideration. The hammers labeled Stanley® Graphite correspond to the two-piece hammer embodiments disclosed herein (data for 16 ounce and 20 ounce hammers are provided). The hammers labeled Stanley® AVX2 correspond to the integrally formed hammer embodiments discussed herein (data for five Stanley® AVX2 hammers are provided, with weights of 16, 20, 22, and 28 ounces; two 20 ounces being indicated, one a nailer and one a framer hammer).

The second column in TABLE 1 provides a nominal weight, measured in ounces, of the hammer under consideration. The third column in TABLE 1 provides a brief description of the hammer. The brief description of the hammer may include information, such as, whether the hammer includes a one-piece, a two-piece or a three-piece construction, and the material of the handle of the hammer under consideration. As noted above, the handle of the hammer may be made from a fiberglass (FG) material, wood, or a steel material. Alternative descriptive information for some models is also provided for identification purposes as will be appreciated by those skilled in the art.

The fourth column in TABLE 1 provides information related to the type of the hammer under consideration. The information related to the type of the hammer under consideration may include whether the hammer is a framer type, or nailer type. The fifth column in TABLE 1 provides the type or the style of the claw disposed on the head of the hammer under consideration. The type or the style of the claw includes rip-type or claw-type.

The sixth column in TABLE 1 provides the overall length dimension OAL, which is the total maximum axial height of the entire hammer (as shown in FIG. 1), of the hammer under consideration. The overall length dimension OAL of the hammer under consideration is measured in inches.

The seventh and the eight column in TABLE 1 provide the diameter "D" of the bell and the diameter "d" of the working strike surface of the hammer under consideration, respectively. The diameter "D" of the bell and the diameter "d" of the striking surface of the hammer are both measured in inches.

Figure 35:
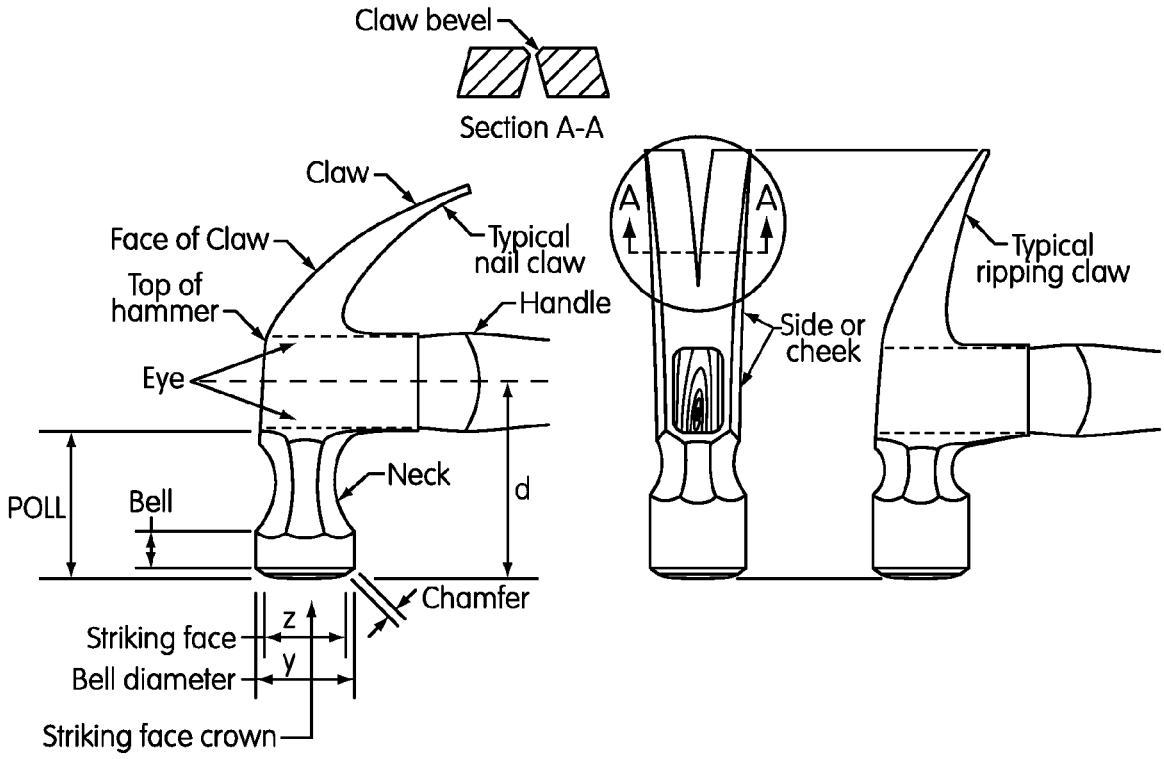
FIG. 35 shows different views of a conventional hammer as illustrated and labeled in American Society of Mechanical Engineers Specification ASME B107.41-2004.
Figure 36:
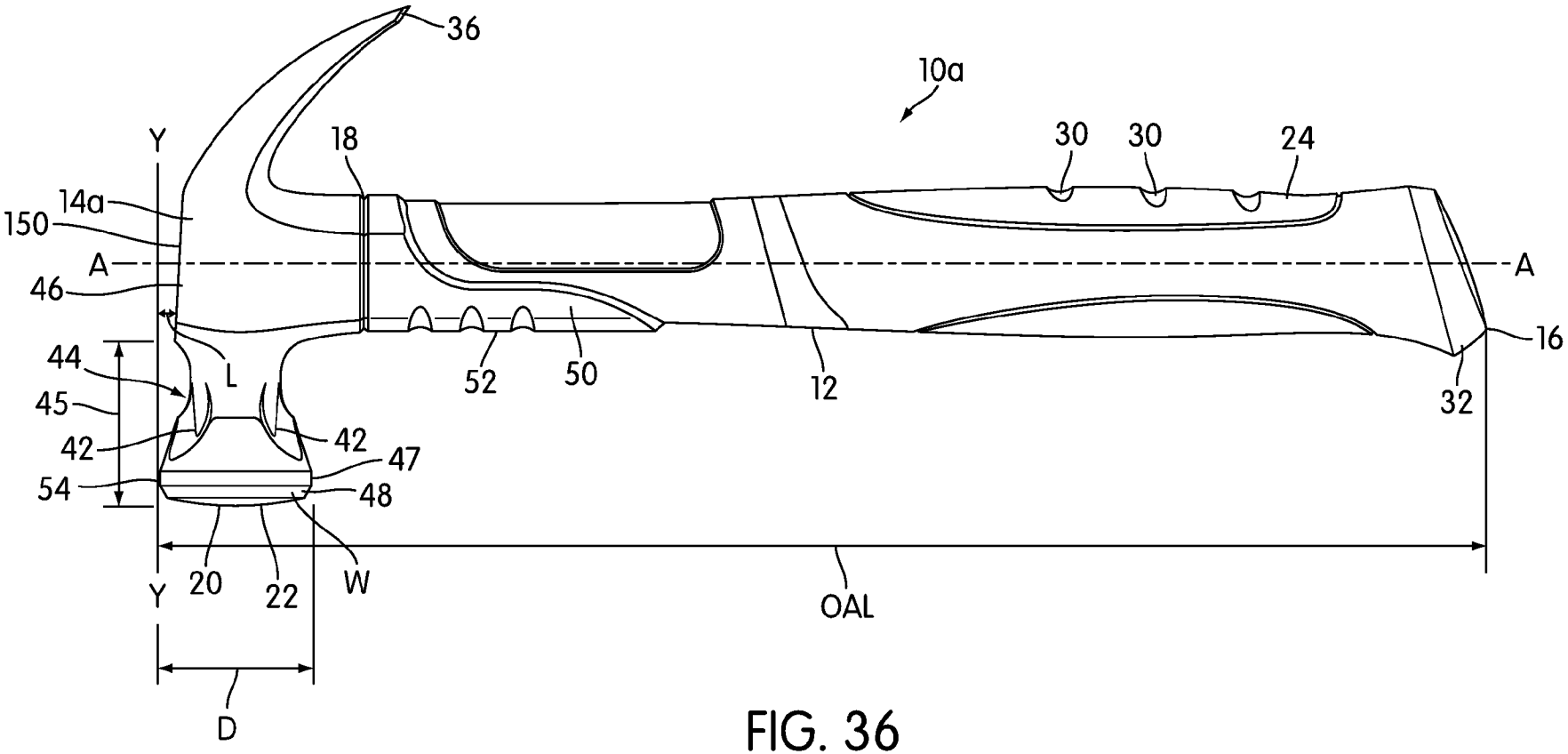
FIG. 36 is a left hand side elevational view of a hammer in accordance with another embodiment of the present invention.
Figure 37:
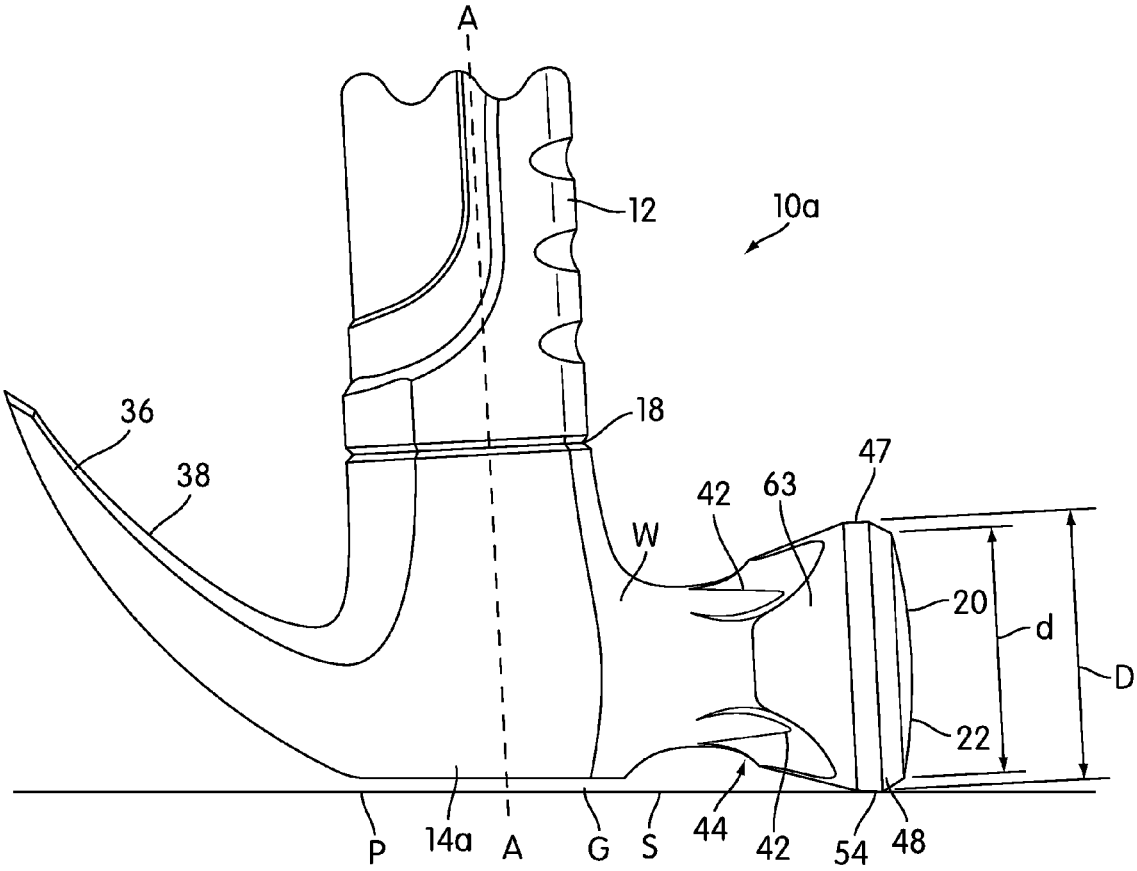
FIG. 37 is a partial left hand side elevational view of the hammer, showing the hammer in an upside down orientation with the head resting on a surface.

FIG. 35 (which is taken from American Society of Mechanical Engineers Specification ASME B107.41-2004) provides a description of typical hammer nomenclature. FIG. 35 has been annotated differently than its original publication to show the diameter of the bell to be represented by a distance "y" and the diameter of the striking surface is represented by a distance "z".

The ninth column in TABLE 1 provides the surface area of the striking surface of the hammer under consideration. The surface area of the striking surface is calculated using the diameter "d" of the striking surface z (which excludes chamfer 48), and is measured in square inches. Hammer faces typically include a slight curvature that may slightly increase the surface area of the striking surface. The values mentioned herein assume a flat face for ease of making calculations. Specifically, the surface areas disclosed herein and to be used in all calculations utilize the outer diameter (or outer/peripheral dimensions in the case of a non-circular strike face) of the striking surface, without taking into account the slight increase in surface area that results from the slight curvature of the striking face. Thus, the surface area of the striking face as disclosed and measured herein is generally measured along a plane having the outer dimensions corresponding to those of the strike face.

The tenth column in TABLE 1 provides a ratio of the overall length dimension OAL of the hammer to the surface area of the striking surface of the head of the hammer for the various hammers under consideration. As noted above, in accordance with an embodiment of the present invention, the ratio of the overall length dimension OAL of the hammer 10 to the surface area of the striking surface 20 of the head 14 is less than 11.0. In accordance with some embodiments of the present invention, the ratio is between 10 and 8.8.

The eleventh column in TABLE 1 provides a ratio of the overall length dimension OAL of the hammer to the bell diameter of the head of the hammer for various hammers under consideration. In accordance with an embodiment of the present invention, the ratio of the overall length dimension OAL of the hammer to the bell diameter of the head of the hammer is less than 11. In accordance with some embodiments of the present invention, the ratio is between 9.94 and 8.02.

The twelfth column in TABLE 1 provides a distance from the striking face to the center of the handle. As shown in FIG. 35, the distance from the striking face to the center of the handle is represented by a distance "d" and is measured in inches. The thirteenth or the last column in TABLE 1 provides a ratio of the distance d from the striking face to the center axis of the handle to the surface area of the striking surface of the hammer for various hammers under consideration.

In one embodiment, the hammer 10 with large strike surface 20 is configured to reduce the delivery of a slanting blow, deflected blow or a blow in an oblique direction. The hammer 10 with large strike surface 20 makes it easier for the user to deliver a strike or a blow against an object, such as a nail or chisel.

FIGS. 36-52 show hammers in accordance with other embodiments of the present invention. The hammers shown include a handle 12 and a head 14*a*. The handle 12 includes a bottom end 16 and an upper portion 18. The head 14*a* is disposed on the upper portion 18 of the handle 12. The head 14*a* includes a striking surface 20 at one end 22 thereof. The head 14*a* also comprises a head weight W.

Hammer 10*a* may include like features as described above with respect to the embodiments of FIGS. 1-34. More specifically, the same reference numerals which represent these similar features are used in FIGS. 1-34 as well as in FIGS. 36-52. For example, the hammer 10*a*, whether integrally formed (as shown in FIGS. 40-45) or a two-piece hammer (as shown in FIGS. 46-52), may comprise nail removing claws 36, a plurality of circumferentially spaced recesses 42, a bell 44 (which includes the striking surface 20), and over-strike protecting structure 50—among the other features described above—as well as the additional features further described below. In addition, the one-piece hammers of FIGS. 40-45 may optionally incorporate Stanley AVX2 specifications of TABLE 1 in FIG. 53, while the two-piece hammers of FIGS. 46-52 may incorporate the specifications of the Stanley Graphite hammers of that same TABLE 1. Furthermore, the hammers as described in FIGS. 1-34 may optionally include one or more of the features described in the below embodiments of FIGS. 36-52. As such, the features of hammers 10 and 10*a* should not be limiting. Similarly, other noted features such as the weights, dimensions (e.g., overall length dimension), materials (e.g., fiberglass), connection methods, types of hammers (e.g., framer, nailer), etc. should also not be limiting for the hammers described in FIGS. 36-52.

Referring to the embodiments as shown in FIGS. 36-52, unlike the prior embodiments, the hammers further comprise a flat surface 47 and the chamfer or bevel 48. The bevel 48 is, in one embodiment, located circumferentially adjacent to the edges of the striking surface 20 of the hammers. The circumferential flat surface 47 may be provided adjacent the chamfer 48. In one embodiment, the circumferential flat surface 47 is provided adjacent the chamfer 48 on its distal side, i.e., away from the striking surface 20, between the chamfer 48 and bell 44. The placement of the circumferential flat surface 47 reduces abrupt changes in the geometry of the head 14*a* of the hammer. The dimension of the circumferential flat surface 47 may vary (e.g., in its width or axial length relative to central axis X of the head). In one embodiment, the flat surface 47 comprises a length between approximately 0.04 inches to approximately 0.09 inches. In one embodiment, it is approximately 0.06 inches. In other embodiments, the circumferential flat surface 47 may be replaced by a circumferential radiussed surface instead of a flat one.

Figure 38:
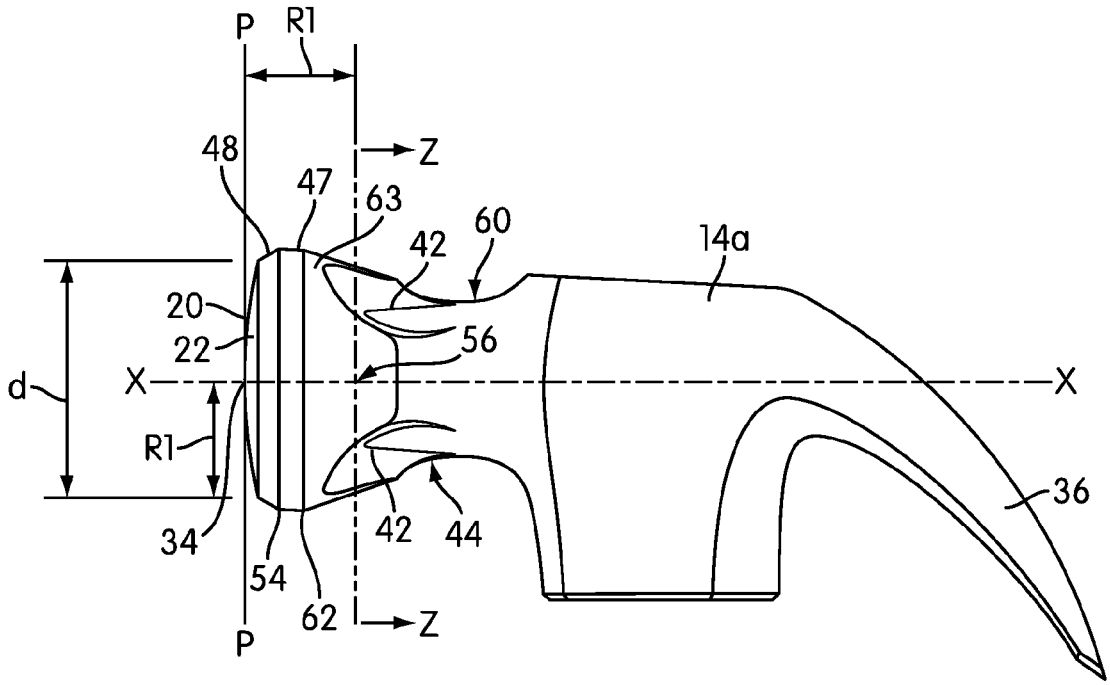
FIG. 38 is a partial left hand side elevational view of the hammer of FIG. 36, showing the radial relationship between the striking surface and the head of the hammer.

The total diameter of the bell 44 is indicated by "D" and includes the dimensions of the flat surface 47 and chamfer 48 (e.g., where the surface 47 and chamfer 48 meet). The diameter of the strike face 20 is indicated at "d" and excludes flat surface 47 and chamfer 48. A first radius measurement "R1" of the strike face 20 is indicated in FIG. 38, and excludes the flat surface 47 and chamfer 48. The radius "R1" is half the amount of the strike face diameter "d." "R1" is a measurement of a distance between an edge of the strike face 20 and a center point 34 of the strike face.

For non-circular strike faces 20, the "R1" dimension is taken as the largest radius (or largest dimension) measured from the center of the strike face. For example, for an oval strike face, the radius corresponding to "R1" as discussed herein would be half (½) of the length of the major axis.

Figure 39:
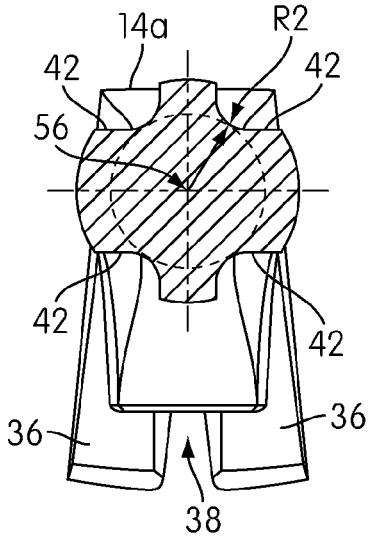
FIG. 39 is a sectional view thereof along the line Z-Z of FIG. 38 in accordance with an embodiment of the present invention.
Figure 40:
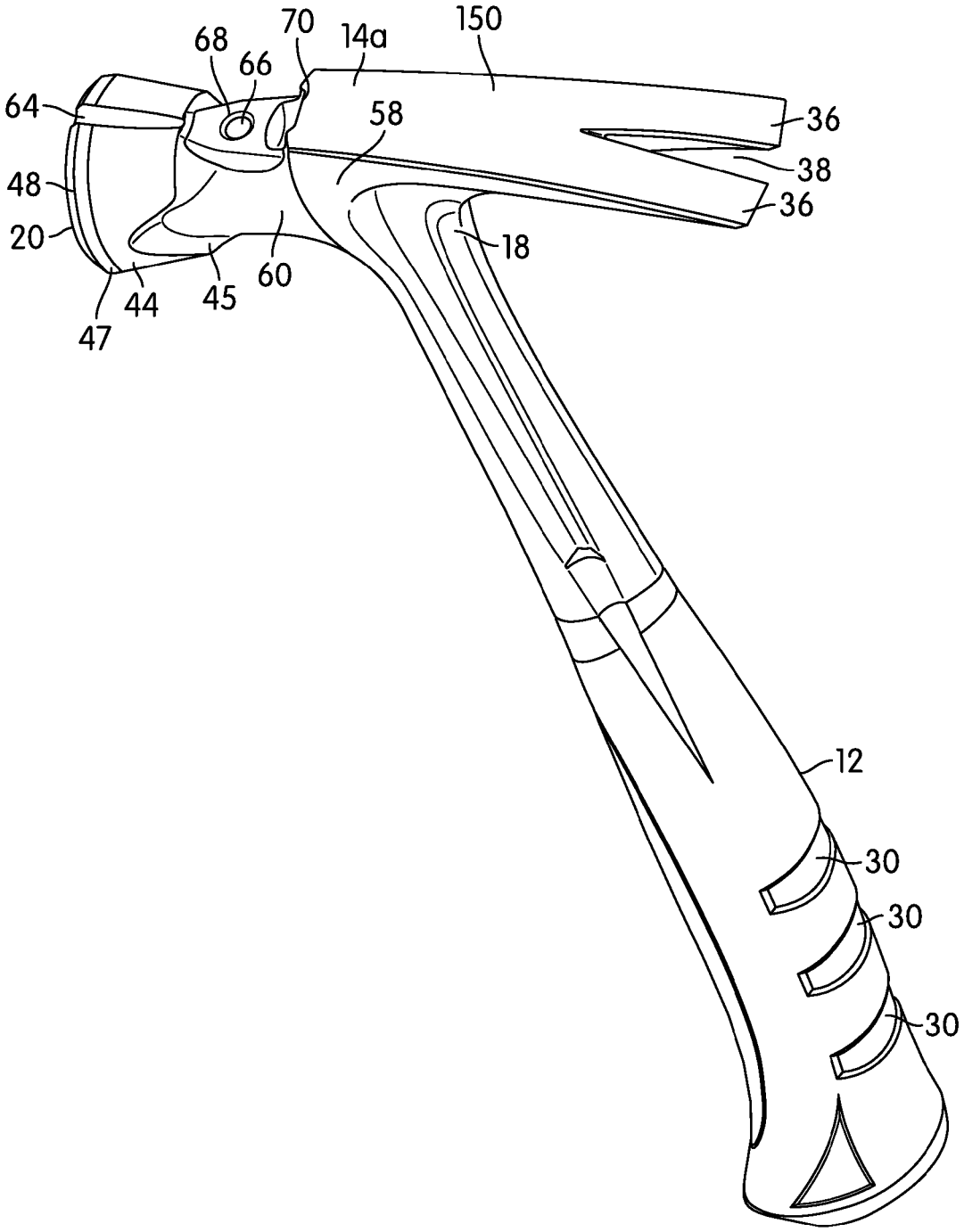
FIG. 40 is a perspective view of an integrally formed hammer of FIG. 36 in accordance with an embodiment of the present invention.
Figure 41:
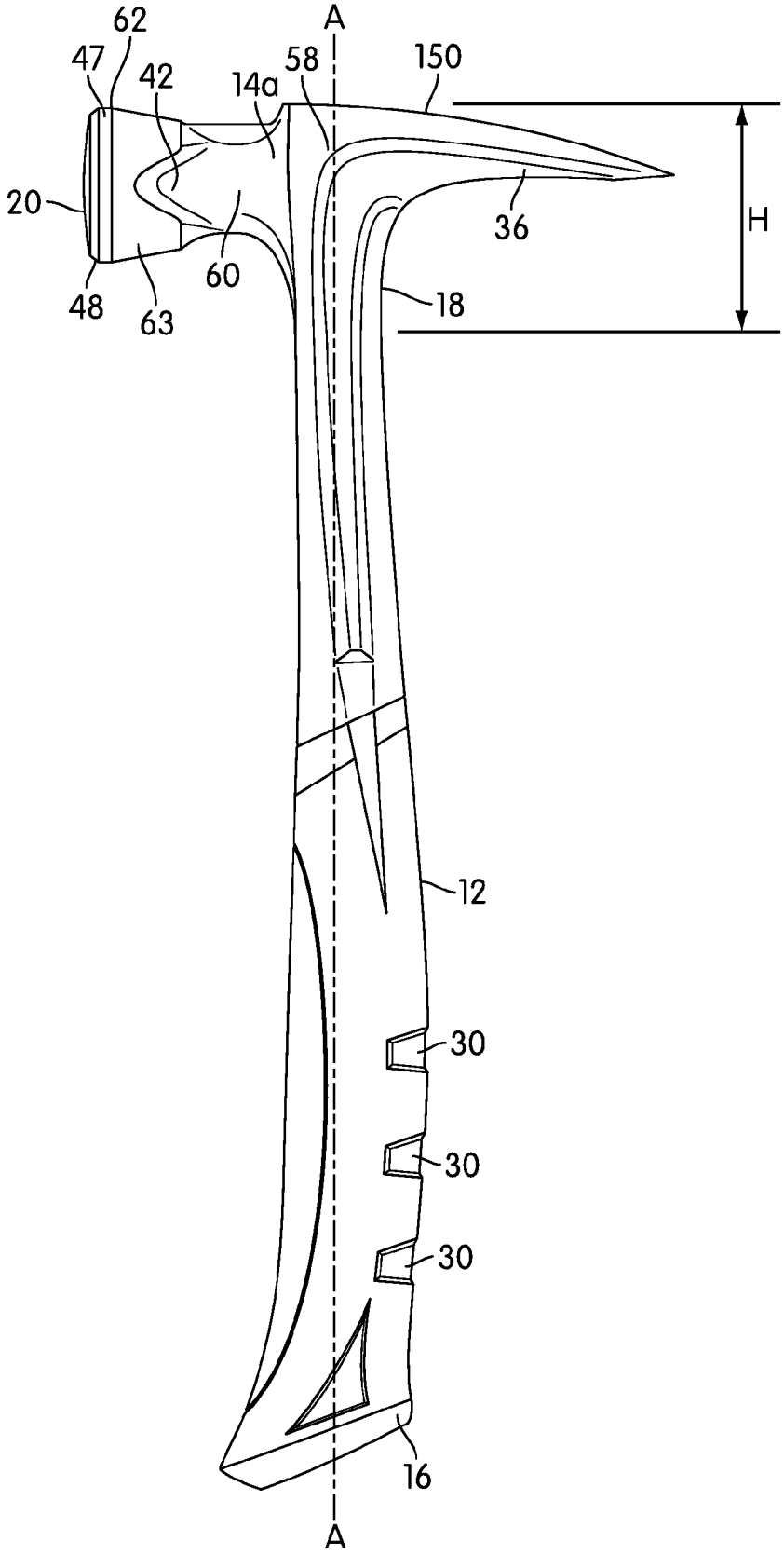
FIG. 41 is a left hand side elevational view of the integrally formed hammer of FIG. 36 in accordance with an embodiment of the present invention.
Figure 42:
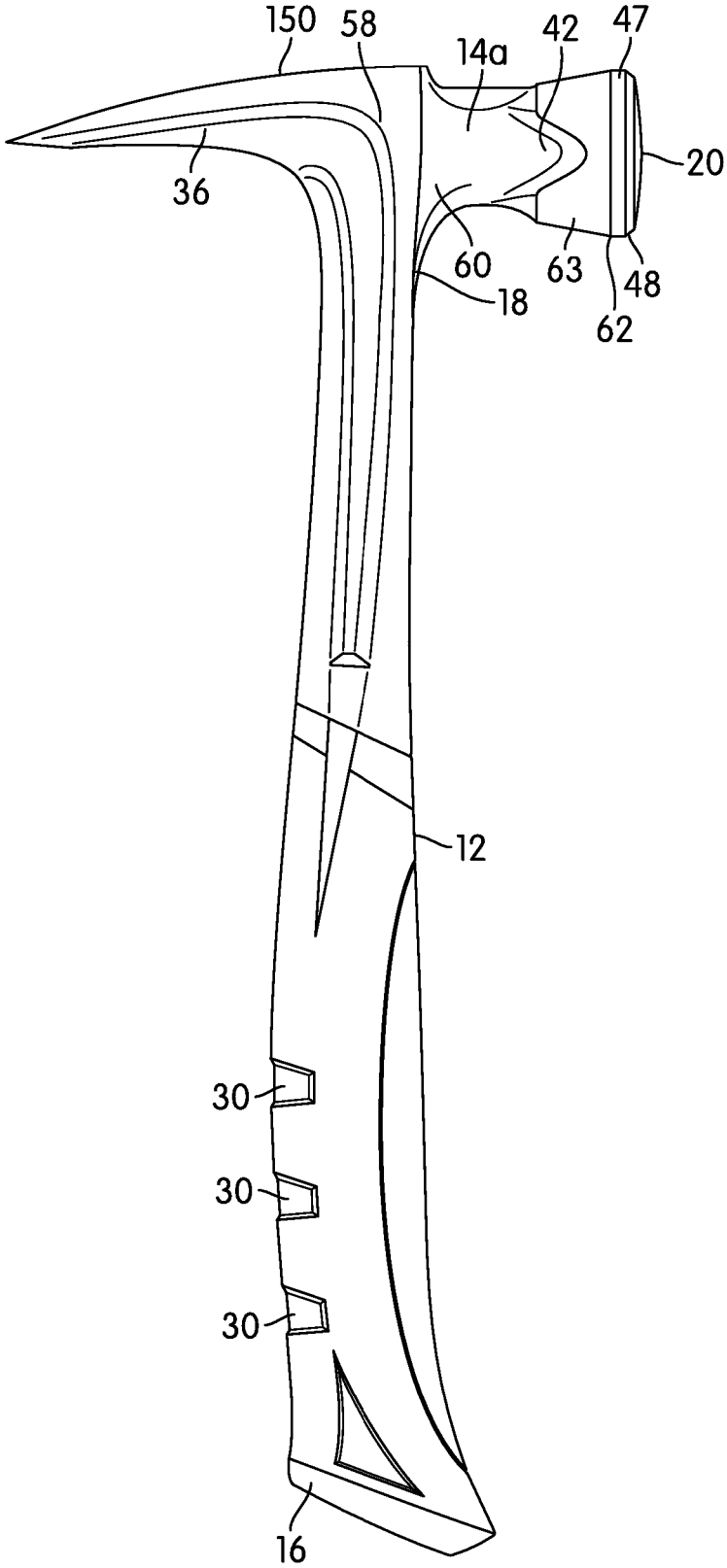
FIG. 42 is a right hand side elevational view of the integrally formed hammer of FIG. 36 in accordance with an embodiment of the present invention.
Figure 43:
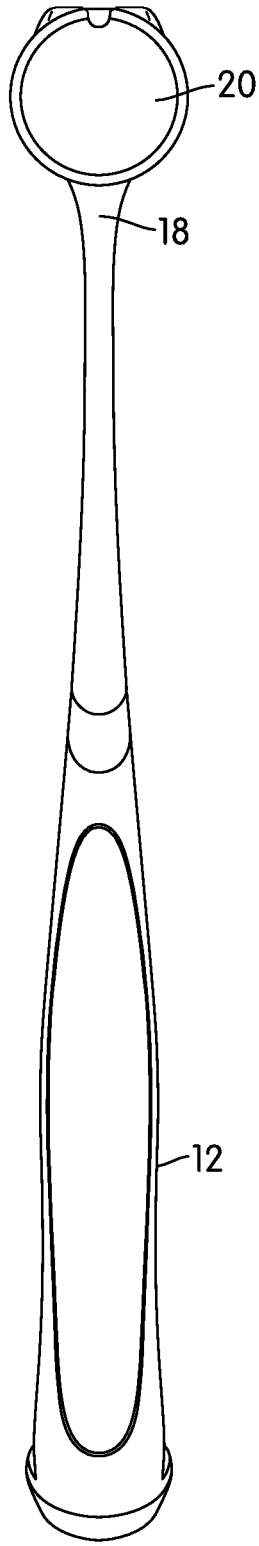
FIG. 43 is a front elevational view of the integrally formed hammer of FIG. 36 in accordance with an embodiment of the present invention.
Figure 44:
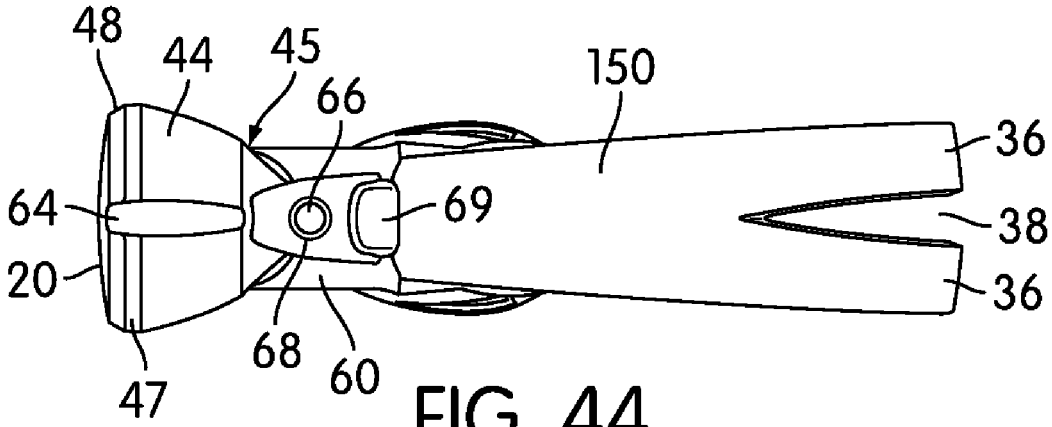
FIG. 44 is a top plan view of the integrally formed hammer of FIG. 36 in accordance with an embodiment of the present invention.
Figure 45:
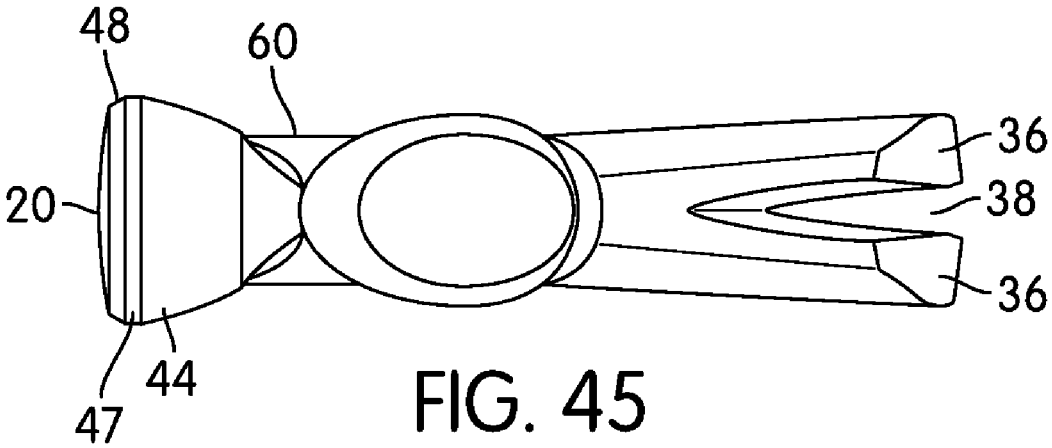
FIG. 45 is a bottom plan view of the integrally formed hammer of FIG. 36 in accordance with an embodiment of the present invention.
Figure 46:
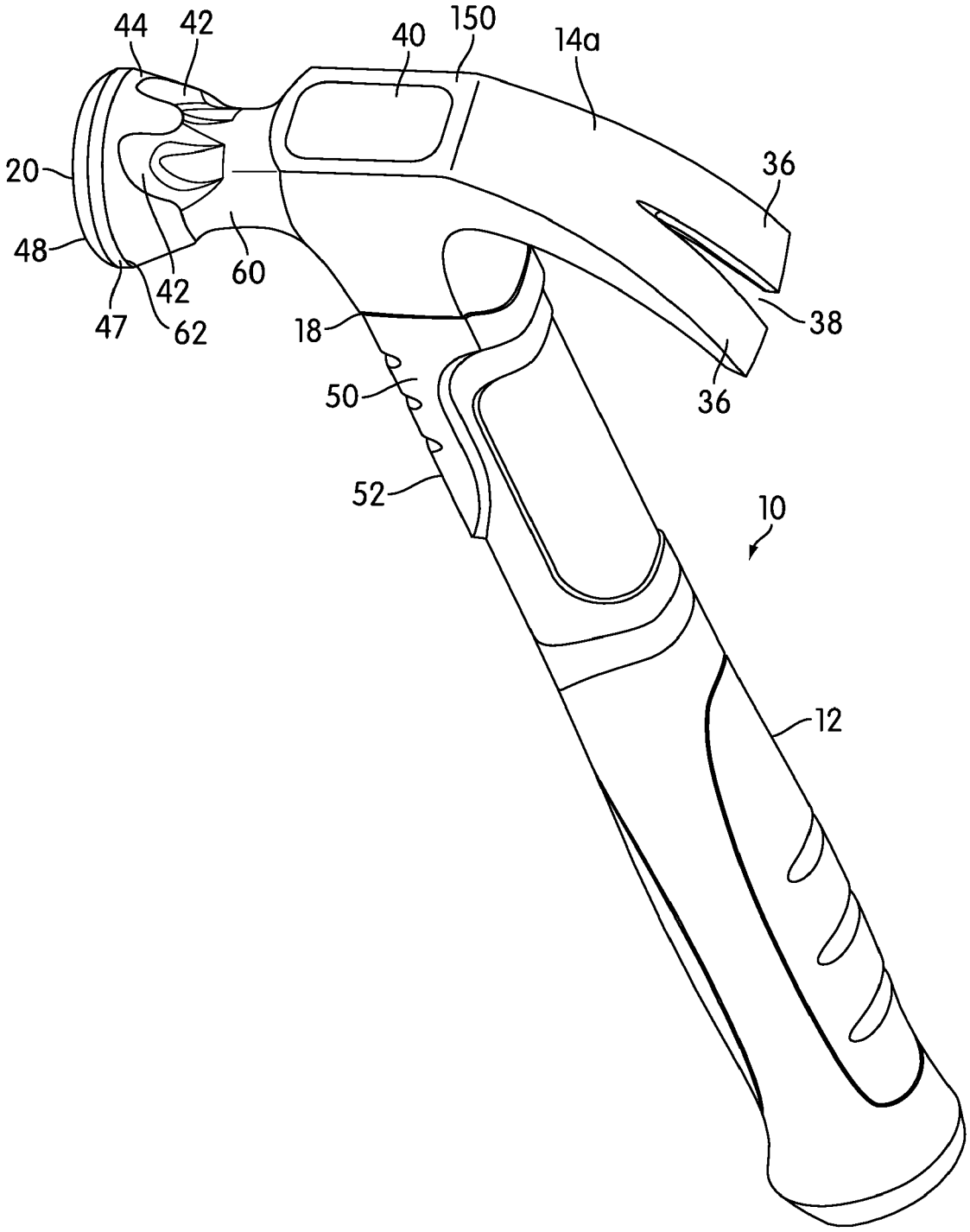
FIG. 46 is a perspective view of a two-piece hammer in accordance with another embodiment of the present invention.
Figure 47:
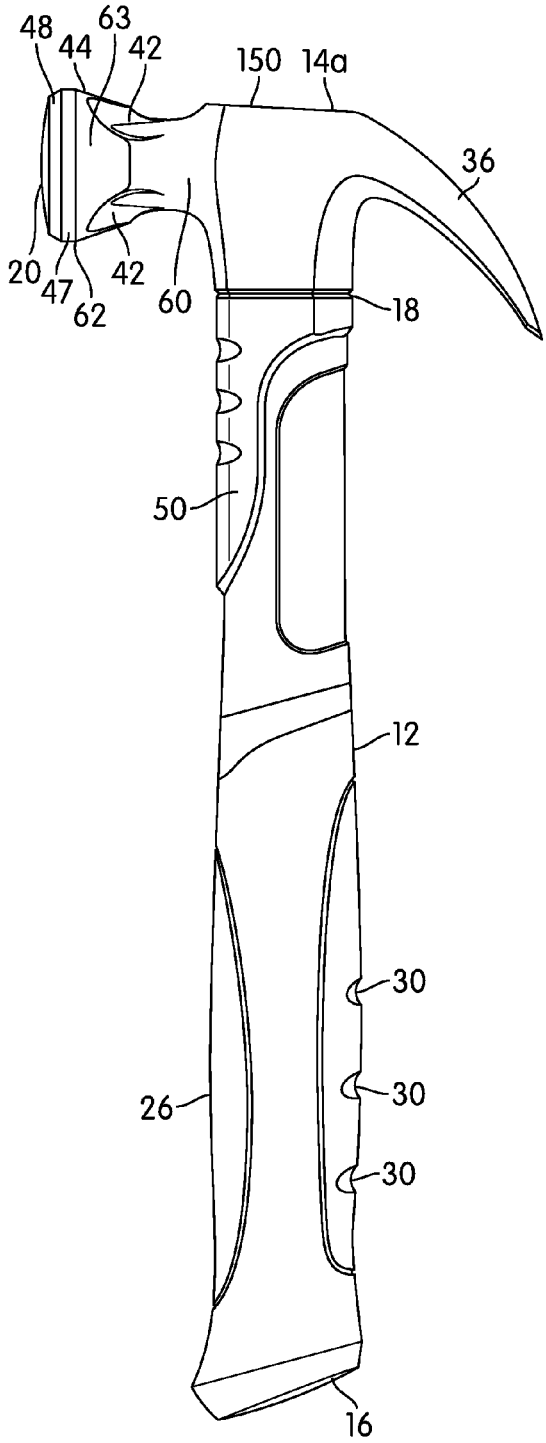
FIG. 47 is a is a left hand side elevational view of the two-piece hammer of FIG. 46 in accordance with an embodiment of the present invention.
Figure 48:
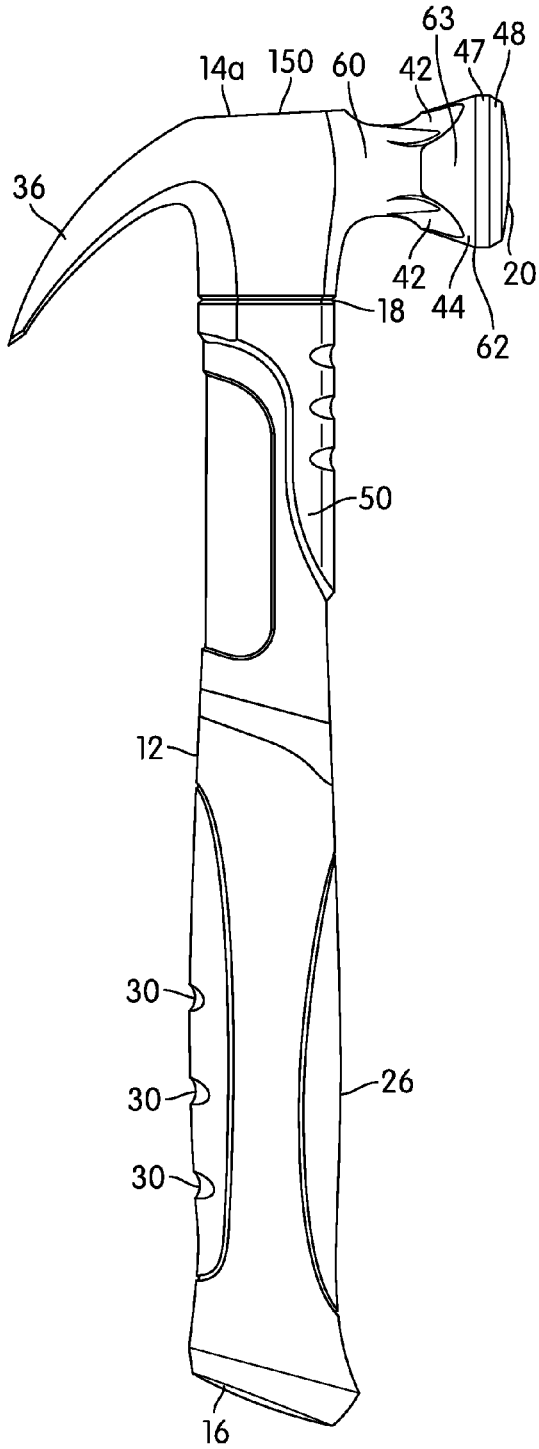
FIG. 48 is a right hand side elevational view of the two-piece hammer of FIG. 46 in accordance with an embodiment of the present invention.
Figure 49:
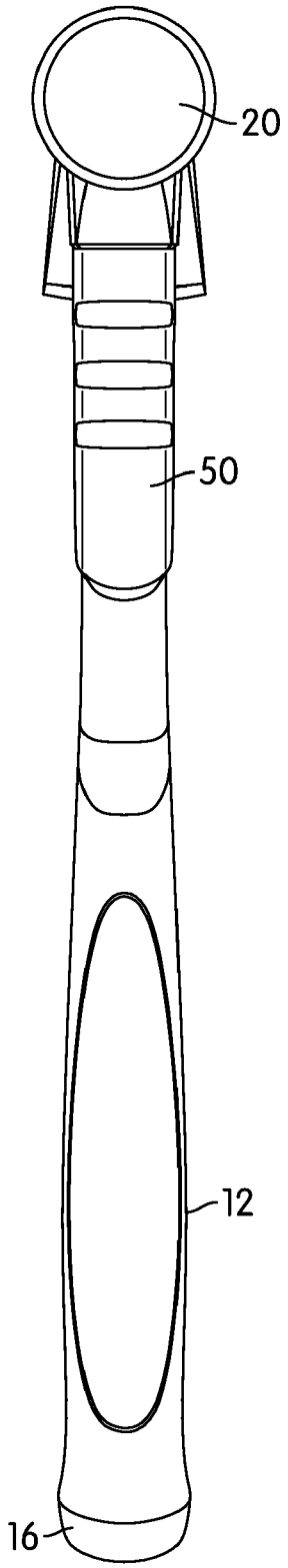
FIG. 49 is a front elevational view of the two-piece hammer of FIG. 46 in accordance with an embodiment of the present invention.
Figure 50:
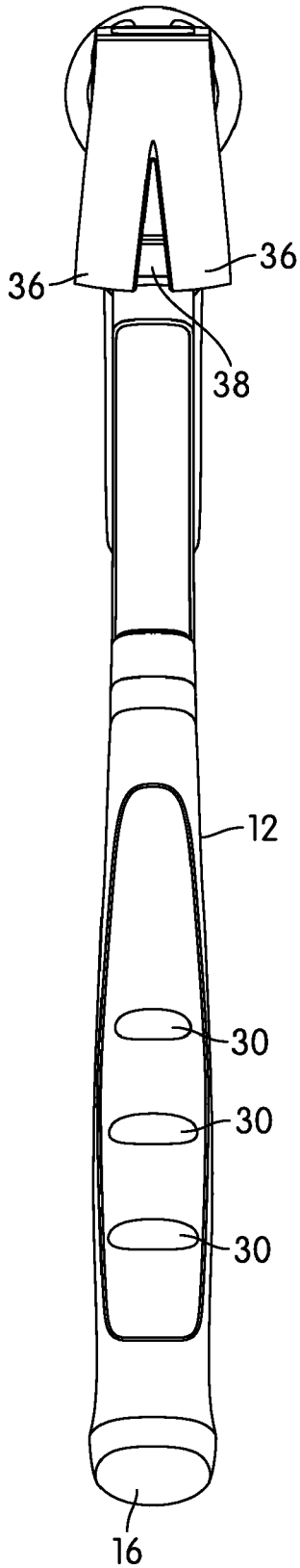
FIG. 50 is a rear elevational view of the two-piece hammer of FIG. 46 in accordance with an embodiment of the present invention.
Figure 51:
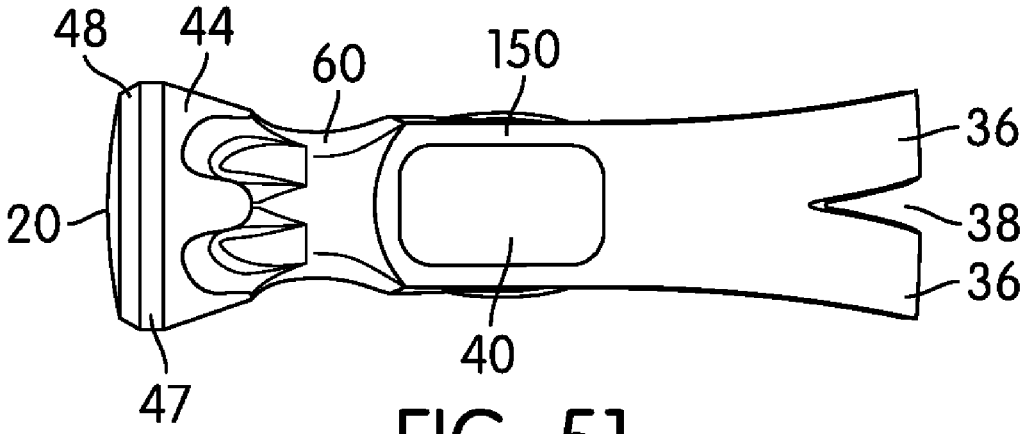
FIG. 51 is a top plan view of the two-piece hammer of FIG. 46 in accordance with an embodiment of the present invention.
Figure 52:
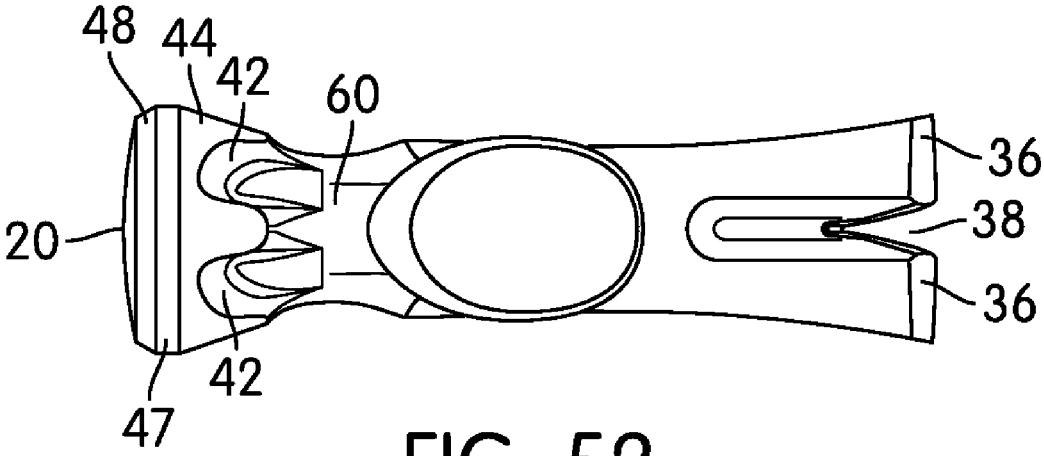
FIG. 52 is a bottom plan view of the two-piece hammer of FIG. 46 in accordance with an embodiment of the present invention.

As shown in FIG. 39, which is a sectional view taken through the line Z-Z in FIG. 38, the head 14*a* of hammer 10*a* also includes a second radius measurement "R2." "R2" is a measurement taken at a section in the bell 44 of the head 14*a* positioned a distance "R1" from the striking surface 20 of the head 14*a*. FIG. 38 shows the horizontal axis X-X through the center point 34 of the strike face 20. To determine the section or location from which to measure "R2," a distance measurement is measured from the center point 34 (which is located in a plane P) through the bell 44 along the horizontal axis X-X (e.g., measured along the top or uppermost surface 150 in a direction parallel to X-X). In a preferred embodiment, the distance measured from the center point 34 is substantially equal to the first radius measurement R1.

The radius measurement "R2" is taken at a section though the hammer head location at a position that is spaced a length or distance from the center point 34 of the strike face, which distance is equal to "R1" (the radius of the strike face) taken along the axis X-X towards the hammer handle.

FIG. 39 illustrates a sectional view of the head 14*a* along the line Z-Z of FIG. 38. FIG. 39 represents a cross sectional view of the head that is taken at a distance substantially equal to the value of R1 from the center point 34 of the striking surface 20. The second radius measurement "R2" is then measured from a center point 56 of this section Z-Z (and lying on axis X-X) to the closest outer surface of the bell 44 of the head 14*a* (i.e., the minimum radius of the section taken across Z-Z). It should be appreciated that the section taken at Z-Z is not circular (as seen FIG. 39), thus, the term "radius" as used herein in not intended to be limited to circular geometries. Center point 56 of the bell 44 and center point 34 of the striking surface 20 are both located on the horizontal central axis X-X. The head configuration discussed above with respect to FIGS. 36-39 may apply equally to one-piece or two-piece hammers described herein.

FIGS. 40-45 show an integrally formed hammer 10*a* in accordance with one embodiment of the present invention. In this embodiment, the head 14*a* of the hammer 10*a* is integrally formed with the upper portion 18 of the handle 12. For example, in an embodiment, the handle may have a metal (e.g., steel or titanium) shaft integrally formed with the head of the same material. In one embodiment, a covering of different material (e.g., an elastomer material) may be provided in surrounding relation to the metal shaft. As noted above, integrally formed hammer 10*a* may be any type of hammer (e.g., framer-type, nailer-type) and its features should not be limiting.

FIGS. 46-52 show different views of a two-piece hammer in accordance with an embodiment of the present invention. In this embodiment, the head and the handle are formed separately and then connected to one another. As discussed with respect to FIGS. 19-25, the head 14*a* of the hammer 10*a* may be disposed on the upper portion 18 of the handle 12 by securing the upper portion 18 of the handle 12 into a portion (e.g., an eye portion 40 as shown in FIGS. 19 and 24) of the head 14*a* of the hammer 10*a*. Any suitable manner of connecting the head 14*a* and handle 12 may be employed. In some embodiments, the handle shaft may be made from a different material than the head. As noted above, two-piece hammer 10*a* may be any type of hammer (e.g., framer-type, nailer-type) and its features should not be limiting.

Though not specifically shown, the diameter of the head 14*a* of the integral hammer 10*a* shown in FIGS. 40-45 or the two-piece hammer 10*a* of FIGS. 46-52 may comprise a gradual taper (i.e., when taking cross sections along lines through the bell 44 and the neck portion 60, such as shown with the hammers in FIGS. 10-18 and FIGS. 26-34). In other embodiments, the diameter of the head 14*a* of the hammers may include other configurations (e.g., parabolic, convex, etc.) The diameter of the head 14*a* of the one-piece and two-piece hammers may decrease gradually from the end 62 of the bell 44 to a central portion 63 of the neck portion 60. The diameter of the head 14 of the one- and two-piece hammers may increase gradually from the central portion 63 of the neck portion 60 to the portion connecting the neck portion 60 and the body portion 58.

FIG. 54 shows a TABLE 2 which provides a comparison and overview of particular embodiments of the integral hammer and of the two-piece hammer, such as those described in FIGS. 36-52, in accordance with the invention disclosed herein in comparison with various hammers across a sampling multiple brands and/or models. Among other things, this table provides a comparative or a relative measurement of the ratio of the head weight W of the hammer to the surface area of the striking surface 20 of the head 14 of the hammer for the various hammers.

The first column in TABLE 2 provides a model number of the hammer under consideration. The hammers labeled Stanley® Graphite (data for nominal 16 ounce and 20 ounce hammers provided) correspond to the two-piece hammer embodiments in accordance with certain aspects of the invention. The hammers labeled Stanley® AVX2 correspond to the integrally formed hammer embodiments in accordance with certain aspects of the invention (data for four Stanley® AVX2 hammers are provided, with nominal weights of 16, 20, 22, and 28 ounces).

The second, third, fourth, fifth, and sixth columns, provide a nominal weight, brief description, information related to the type of hammer, type or style of the claw, and the overall length dimension OAL, respectively, of the hammer under consideration.

The seventh and the eight columns in TABLE 2 provide the diameter "D" of the bell (including the chamfer 48 if one is provided) and the diameter "d" of the working strike surface of the hammer under consideration, respectively. The diameter "D" of the bell and the diameter "d" of the striking surface of the hammer are both measured in inches.

The ninth column in TABLE 2 provides the surface area of the striking surface of the hammer under consideration. The surface area of the striking surface is calculated using the diameter "d" of the striking surface z (which excludes chamfer 48), and is measured in square inches. Hammer faces typically include a slight curvature (so as to be slightly convex) that may slightly increase the surface area of the striking surface in comparison with a planar surface having the same outer diameter. The values mentioned herein assume a flat (planar) face for ease of making calculations. Specifically, the surface areas disclosed herein and to be used in all calculations utilize the outer diameter (or outer/peripheral dimensions in the case of a non-circular strike face) of the striking surface, without taking into account the slight increase in surface area that results from the slight curvature of the striking face. Thus, the surface area of the striking face as disclosed and measured herein is generally measured along a plane having the outer dimensions corresponding to those of the strike face.

The tenth and eleventh columns in TABLE 2 provide a ratio of the overall length dimension OAL (measured in inches) of the hammer to the surface area (measured in square inches) of the striking surface of the head of the hammer, and a ratio of the overall length dimension OAL of the hammer (measured in inches) to the bell diameter of the head of the hammer (measured in inches), respectively, for the various hammers under consideration. In accordance with some embodiments of the present invention, the ratio of the overall length dimension OAL of the hammer 10 to the surface area of the striking surface 20 of the head 14 may be less than 11.0. In other embodiments and claims relating to the shape of the head, weight to surface area ratio, or relative radiuses, this OAL to surface area ratio may be greater than 11.0. For the avoidance of doubt, each independent claim herein stands on its own merit and is not dependent on or inclusive of limitations of other independent claims.

The twelfth and thirteenth columns in TABLE 2 relate to measurements taken for hammers having a two piece head configuration. That is, these columns correspond to those various hammers having a head that is configured to be mounted on the upper portion of separately formed handle, such as shown in FIGS. 46-52. The fourteenth and fifteenth columns relate to measurement taken for hammers having an integral or one piece head configuration, i.e., a hammer whose head is integrally formed with the upper portion of the handle, such as shown in FIGS. 40-45.

The twelfth column indicates the weight of the hammer head for a two piece hammer, for the various two-piece hammers under consideration. The head weight W of the head 14*a* is weighed as a separate unit from the handle, and measured in ounces (oz). The thirteenth column indicates a ratio of the hammer head weight (measured in inches) to the surface area (measured in square inches) of the striking face of the head of the hammer for the various hammers under consideration. In accordance with an embodiment of the present invention, the ratio of the head weight of the hammer to the surface area of the striking surface of the head is less than 14.0, although in other embodiments it may be greater than 14.0.

The fourteenth column provides a hammer head weight for a one piece or integrally formed hammer for the various hammers of integral construction under consideration. In this case, in order to determine the head weight W of an integral hammer, the head is defined as an upper portion of the hammer taken at a distance H from the top or uppermost surface 150 of the head 14*a* along axis A-A (e.g., see FIG. 41). In the disclosed embodiment, the distance H for defining the head is three (3.0) inches from the top surface 150. In TABLE 2 of FIG. 54, the head weight W is weighed for each one piece hammer head by cutting off the head (e.g., by sawing) at a 3-inch location H (from the top surface 150 of head 14*a*) to remove the bell portion, poll, and other portions of the head 14*a*. Such head weights (in ounces) for the various hammers under consideration are thus shown in the fourteenth column. The fifteenth column provides a ratio of the one-piece head weight (measured in ounces, at 3 inches) to the surface area (measured in square inches) of the striking face 20 of the head of the hammer for the various hammers under consideration. In accordance with an embodiment of the present invention, the ratio of the head weight of the hammer to the surface area of the striking surface of the head is less than 16.25.

FIG. 55 shows a TABLE 3 which provides a comparison and overview of particular embodiments of the integral hammer and of the two-piece hammer, such as those described in FIGS. 36-52, in accordance with the invention disclosed herein in comparison with various hammers across a sampling multiple brands and/or models. This table provides a comparative or a relative measurement of the ratio of the radius measurement R2 of the head 14*a* as defined herein to the radius measurement R1 of the striking surface 20 of the head 14*a* of the hammer for the various hammers.

The first column in TABLE 3 provides a manufacturer name of the hammer under consideration. The second column in TABLE 3 provides a model number of the hammer under consideration. The hammers labeled Stanley® Graphite correspond to data for nominal 16 ounce and 20 ounce hammer embodiments. The hammers labeled Stanley® AVX2 correspond to data for four Stanley® AVX2 hammers in accordance with one aspect of the invention, with weights of 16, 20, 22, and 28 ounces. The third column provides the nominal weight, in ounces (oz), of the hammer under consideration.

The fourth and fifth columns of TABLE 3 correspond to a first radius measurement R1 (measured in inches) and a second radius measurement R2 (measured in inches) of the head of the hammer for the various hammers under consideration. As noted above with respect to FIG. 38, the first radius measurement R1 is taken of the striking surface 20 of the head. R1 is defined as half of the diameter "d" of the striking surface 20. The values of the fourth column of TABLE 3 (R1 measurements) assume a flat face for ease of making calculations (e.g., measurement taken by use of calipers); however, it is noted that striking faces may include a slight curvature. The second radius measurement R2 is defined as the radial measurement taken at a cross-section of the head positioned a distance R1 (half the diameter of the striking face) from striking surface of the head. As described above, the second radius measurement R2 is taken from the center point 56 (along a central horizontal axis X-X) to the closest radial outer surface of the head 14*a* of the hammer 10*a* (e.g., see FIGS. 38 and 39).

The sixth column provides a ratio of the second radius measurement R2 to the first radius measurement R1 of the head of the hammer for the various hammers under consideration. In accordance with one aspect of the present invention, the radio of the second radius measurement to the first radius measurement (R2/R1) of the head of the hammer is less than 1.0.

To measure a hammer in accordance with the above, the diameter d of the striking surface is first measured (e.g., with calipers). The radius R1 is then determined by taking half the measurement of the diameter d. The head of the hammer is then measured to determine R2. R2 is a radius of a cross-section of the hammer head, wherein the cross-section is taken at a distance spaced from the strike surface. Specifically the cross-section can be taken at a distance from the strike surface that is equal to the length (or distance) of R1. The distance or length (e.g., equal to R1) is measured from a central point on the strike surface, along a central axis X-X through the bell of the hammer, toward the hammer handle axis. At that distance (R1), R2 is determined by taken the shortest distance from the central axis X-X to the (closest) exterior surface of the head in a radial direction. To facilitate measuring R2 on a physical hammer, it may be easiest to cut (e.g., by sawing technology) (along section Z-Z) through the head at a distance R1 from the strike surface in a direction generally perpendicular to axis X-X and then measuring the distance R2 from the axis X-X to the closest outer surface. FIGS. 38 and 39 illustrate an example of the radial relationship between the striking surface and the head of the hammer.

The hammers 10 and 10*a* disclosed herein provide a large strike face without adding weight to the head of the hammer. Specifically, the hammers disclosed herein, and characterized in TABLES 1, 2, and 3, have a greater strike surface 20 surface area than other hammers within the same nominal weight class.

Other data of TABLES 1, 2, and 3 further indicates various differences of the hammers of the present invention over conventional hammers. Not all of these differences are discussed in detail in this specification, but the different relationships of various dimensions, weights and sizes are disclosed in, or can be derived from TABLE 1, TABLE 2, and/or TABLE 3 of FIGS. 53-55. The various differences over the prior art can also be derived from the drawings, and each of these differences can be viewed or taken from different independently patentable vantage points as may be claimed.

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. In addition, it is to be understood that the present invention contemplates that, to the extent possible, one or more features of any embodiment can be combined with one or more features of any other embodiment.

What is claimed is:

1. A hammer comprising:

a handle, the handle having a bottom end and an upper portion; and a head disposed on the upper portion of the handle, the head having a striking surface at one end thereof;

the hammer having an overall length dimension;

wherein the head is formed from steel, the head including a body portion, a bell, and a neck portion that connects the bell with the body portion, wherein the neck portion has a reduced diameter in comparison with the bell, wherein the bell includes a convex strike surface in both horizontal and vertical directions, and a chamfer disposed along edges of the strike surface, and wherein a ratio of the overall length dimension of the hammer measured in inches to the surface area of the striking surface of the head measured in square inches is less than 11.0.

2. The hammer of claim 1, wherein the ratio is between 10.0 and 8.8.

3. The hammer of claim 1, further comprising a plurality of circumferentially spaced recesses located adjacent to but spaced from the striking surface of the head.

4. The hammer of claim 1, further comprising an over-strike protecting structure constructed and arranged to surround a portion of the handle adjacent to the upper portion of the handle, the over-strike protecting structure is constructed and arranged to prevent breakage of the handle, when the hammer fails to strike an intended object.

5. The hammer of claim 4, wherein the over-strike protecting structure comprising an additional layer of material molded on a portion of the handle to dissipate impact energy and stress due to an overstrike.

6. The hammer of claim 1, wherein the head is integrally formed with the upper portion of the handle.

7. The hammer of claim 1, wherein the head is mounted on the upper portion of the handle by inserting the upper portion of the handle into a portion of the head of the hammer.

8. The hammer of claim 1, wherein the bell tapers so as to be reducing in diameter as it extends away from the chamfer.

9. The hammer of claim 8, wherein the bell is devoid of a cylindrically shaped structure, and wherein the tapered portion of the bell adjoins the chamfer.

10. A hammer comprising:

a handle, the handle having a bottom end and an upper portion; and a head disposed on the upper portion of the handle, the head having a striking surface at one end thereof;

wherein the head is formed from steel, the head including a body portion, a bell, and a neck portion that connects the bell with the body portion, wherein the neck portion has a reduced diameter in comparison with the bell, wherein the bell includes a convex strike surface in both horizontal and vertical directions, and a chamfer disposed along edges of the strike surface, wherein the bell tapers so as to be reducing in diameter as it extends away from the chamfer, and wherein the head comprises a plurality of circumferentially spaced recesses located adjacent to but spaced from the striking surface of the head.

11. The hammer of claim 10, wherein the bell is devoid of a cylindrically shaped structure, and wherein the tapered portion of the bell adjoins the chamfer.

12. A hammer comprising:

a handle, the handle having a bottom end and an upper portion; and a head disposed on the upper portion of the handle, the head having a striking surface at one end thereof and a head weight;

the head being integrally formed with the upper portion of the handle, wherein the head is formed from steel, the head including a body portion, a bell, and a neck portion that connects the bell with the body portion, wherein the neck portion has a reduced diameter in comparison with the bell, wherein the bell includes a convex strike surface in both horizontal and vertical directions, and a chamfer disposed along edges of the strike surface, and wherein a ratio of the head weight of the hammer, measured in ounces at 3.0 inches from the top of the head, to the surface area of the striking surface of the head measured in square inches, is less than 16.25.

13. The hammer of claim 12, further comprising a plurality of circumferentially spaced recesses located adjacent to but spaced from the striking surface of the head.

14. The hammer of claim 12, wherein the head further comprises a chamfer circumferentially along edges of the striking surface.

15. The hammer of claim 14, wherein the head further comprises a flat surface circumferentially along edges of the chamfer.

16. The hammer of claim 12, further comprising an over-strike protecting structure constructed and arranged to surround a portion of the handle adjacent to the upper portion of the handle, the over-strike protecting structure is constructed and arranged to prevent breakage of the handle, when the hammer fails to strike an intended object.

17. The hammer of claim 16, wherein the over-strike protecting structure comprising an additional layer of material molded on a portion of the handle to dissipate impact energy and stress due to an overstrike.

18. The hammer of claim 12, wherein the bell tapers so as to be reducing in diameter as it extends away from the chamfer.

19. The hammer of claim 18, wherein the bell is devoid of a cylindrically shaped structure, and wherein the tapered portion of the bell adjoins the chamfer.

20. A hammer comprising:

a handle, the handle having a bottom end and an upper portion; and a head formed separately from the handle and connected to the upper portion of the handle, the head having a striking surface at one end thereof and a head weight, wherein the head is formed from steel, the head including a body portion, a bell, and a neck portion that connects the bell with the body portion, wherein the neck portion has a reduced diameter in comparison with the bell wherein the bell includes a convex strike surface in both horizontal and vertical directions, and a chamfer disposed along edges of the strike surface, and wherein a ratio of the head weight of the hammer measured in ounces to the surface area of the striking surface of the head measured in square inches is less than 14.0.

21. The hammer of claim 20, further comprising a plurality of circumferentially spaced recesses located adjacent to but spaced from the striking surface of the head.

22. The hammer of claim 20, wherein the head further comprises a chamfer circumferentially along edges of the striking surface.

23. The hammer of claim 22, wherein the head further comprises a flat surface circumferentially along edges of the chamfer.

24. The hammer of claim 20, further comprising an over-strike protecting structure constructed and arranged to surround a portion of the handle adjacent to the upper portion of the handle.

25. The hammer of claim 24, wherein the head is configured to be mounted on the upper portion of the handle by inserting the upper portion of the handle into a portion of the head of the hammer.

26. The hammer of claim 20, wherein the bell tapers so as to be reducing in diameter as it extends away from the chamfer.

27. The hammer of claim 26, wherein the bell is devoid of a cylindrically shaped structure, and wherein the tapered portion of the bell adjoins the chamfer.

28. A hammer comprising:

a handle, the handle having a bottom end and an upper portion; and a head disposed on the upper portion of the handle, the head having a striking surface at one end thereof;

wherein the head is formed from steel, the head including a body portion, a bell, and a neck portion that connects the bell with the body portion, wherein the neck portion has a reduced diameter in comparison with the bell, wherein the bell includes a convex strike surface in both horizontal and vertical directions, and a chamfer disposed along edges of the strike surface, the striking surface of the head having a first radius measurement generally taken from a central axis of the striking surface to a periphery of the striking surface;

the head of the hammer having a second radius measurement, the second radius measurement being measured at a section of the head that is positioned a distance from the striking surface of the head along the central axis, the second radius measurement generally taken from the central axis to the closest outer surface of the head;

the distance from the striking surface at which the second radius measurement is taken being substantially equal to the first radius measurement, and wherein a ratio of the second radius measurement to the first radius measurement is of the head is less than 1.0.

29. The hammer of claim 28, wherein the head is integrally formed with the upper portion of the handle.

30. The hammer of claim 28, wherein the head is formed separately from the handle and connected to the upper portion of the handle by inserting the upper portion of the handle into a portion of the head of the hammer.

31. The hammer of claim 28, further comprising a plurality of circumferentially spaced recesses located adjacent to but spaced from the striking surface of the head.

32. The hammer of claim 28, wherein the head further comprises a chamfer circumferentially along edges of the striking surface.

33. The hammer of claim 32, wherein the head further comprises a flat surface circumferentially along edges of the chamfer.

34. The hammer of claim 28, further comprising an over-strike protecting structure constructed and arranged to surround a portion of the handle adjacent to the upper portion of the handle, the over-strike protecting structure is constructed and arranged to prevent breakage of the handle, when the hammer fails to strike an intended object.

35. The hammer of claim 34, wherein the over-strike protecting structure comprising an additional layer of material molded on a portion of the handle to dissipate impact energy and stress due to an overstrike.

36. The hammer of claim 28, wherein the ratio of the second radius measurement to the first radius measurement is less than 0.95.

37. The hammer of claim 28, wherein the ratio of the second radius measurement to the first radius measurement is less than 0.90.

* * * * *